US006934492B2

(12) United States Patent
Hiura et al.

(10) Patent No.: US 6,934,492 B2
(45) Date of Patent: Aug. 23, 2005

(54) TONER SUPPLY CONTAINER, IMAGE FORMATION UNIT AND IMAGE FORMING APPARATUS

(75) Inventors: Hiroshi Hiura, Toride (JP); Kazuyoshi Sasae, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 10/461,518

(22) Filed: Jun. 16, 2003

(65) Prior Publication Data

US 2004/0037592 A1 Feb. 26, 2004

(30) Foreign Application Priority Data

Jun. 19, 2002 (JP) ..... 2002/178077
Jun. 19, 2002 (JP) ..... 2002/178080

(51) Int. Cl.[7] ..... G03G 15/08
(52) U.S. Cl. ..... 399/258; 399/111; 399/120
(58) Field of Search ..... 222/DIG. 1; 399/111, 399/119, 120, 258, 262, 263

(56) References Cited

U.S. PATENT DOCUMENTS 5,890,034 A * 3/1999 Nakano et al. ..... 399/106

FOREIGN PATENT DOCUMENTS

| | | |
|---|---|---|
| JP | 3-38662 | 2/1991 |
| JP | 7-199620 | 8/1995 |

* cited by examiner

*Primary Examiner*—Hoang Ngo
(74) *Attorney, Agent, or Firm*—Fitzpatrick, Cella, Harper & Scinto

(57) ABSTRACT

An image forming unit detachably mountable to an image forming apparatus, includes an image forming device that forms a toner image. A mounting device is provided in the image forming unit for mounting a toner supply container that supplies toner to the image forming device. The mounting device is such that the toner supply container is mountable to and dismountable from the image forming unit which is mounted in the image forming apparatus.

15 Claims, 33 Drawing Sheets

| | FIG. 17 | FIG. 18(b) | FIG. 18(c) | FIG. 19 | FIG. 20 |
|---|---|---|---|---|---|
| CVR SW | ON | OFF | ON | ON | ON |
| SUPPLY OPENING CVR SW | ON | ON | ON | OFF | OFF |
| PHOTO-SNSR 106 | ON | OFF | OFF | OFF | OFF |
| PHOTO-SNSR 106′ | OFF | OFF | OFF | ON | OFF |
| HOOK 41 | OPEN | LOCK | LOCK | OPEN | LOCK |
| HOOK 42 | OPEN | OPEN | OPEN | LOCK | LOCK |

FIG. 21

TONER SUPPLY CONTAINER, IMAGE FORMATION UNIT AND IMAGE FORMING APPARATUS

FIELD OF INVENTION AND RELATED ARTS

The present invention relates to an image forming apparatus for forming images using an electrophotographic or electrostatic recording method, an image formation unit removably mountable in an image forming apparatus, and a toner supply container for supplying an image formation unit with toner.

As for examples of an image forming apparatus, there are copying machines, printers, facsimile machines, etc.

Copying machines, facsimile machines, etc., employ an image forming apparatus, which forms images with the use of an electrophotographic image formation method. In this type of electrophotographic image forming apparatus, an image is formed on recording medium through the following steps: an electrostatic latent image is formed on a photoconductive drum; the electrostatic latent image is developed into a visible image, that is, an image formed of toner using toner; and the toner image is transferred onto transfer medium. A photoconductive drum deteriorates with use; in other words, a photoconductive drum is a consumable component. Further, an image forming apparatus needs to be supplied with a fresh supply of toner as necessary.

Therefore, it has been a common practice to integrally dispose a photoconductive drum 201 and a development device 202 in a cartridge (process cartridge) 200 removably mountable in the main assembly of an image forming apparatus, as shown in FIG. 22(*a*), so that components such as the photoconductive drum 201, etc., can be replaced by replacing the process cartridge 200.

For a certain length of usage of the development device 202 of the process cartridge 200, the development device 202 must be replenished with toner. Therefore, the development device 202 and a toner container 203 are structured so that a toner container 203 is removably mountable in the development device 202. More specifically, referring to FIGS. 22(*a*) and 22(*b*), the development device 202 is provided with a cover 204 and a toner container mounting space 205. Thus, as the toner container 203 is depleted of toner, a user can open the cover 204 of the development device 202 by rotating the cover 204 in the direction indicated by an arrow mark S, pull out the empty toner container 203 from the toner container mounting space 205 in the direction indicated by an arrow mark T, insert a new toner container (203) into the toner container mounting space 205, in the direction opposite to the direction of the arrow mark T, and close the cover 204 by rotating the cover in the direction opposite to the direction of the arrow mark S.

Referring to FIG. 23, the main assembly of an image forming apparatus, and the process cartridge 200, are structured so that the process cartridge 200 can be removably mounted into the image formation station to make it possible to remove a single or a plurality of sheets of recording medium having been stuck in the recording medium conveyance path located below the process cartridge 200 mounting space, replace an empty toner container 203 to supply the process cartridge 200 with toner, or to carry out the like processes.

Japanese Laid-open Patent Application 3-38662 discloses a copying machine structured so that a toner supply container can be removed from a process cartridge only when the process cartridge is out of the main assembly of the copying machine.

However, in the case of a conventional structural arrangement such as the one shown in FIG. 22, the process cartridge 200 is removed from the main assembly of the image forming apparatus in order to supply the process cartridge 200 with toner. Therefore, if toner remains in the toner container 203 even in a small amount, there is the possibility that the toner will fall out from the downward facing opening of the toner container 203 and/or that the toner will leak if the process cartridge 200 is turned over before the mounting or dismounting of the toner container 203 is completed.

Further, in the case of the copying machine disclosed in Japanese Laid-open Patent Application 3-38662, the process cartridge 200 must be removed from the main assembly of the copying machine just for the replacement of the toner supply container, making the toner replenishment operation very troublesome to an operator.

Japanese Laid-open Patent Application 7-199620 discloses an image forming apparatus structured so that the toner outlet of the cylindrical toner cartridge can be connected to the toner inlet of the development device by rotating the toner cartridge with the use of the handle attached to the front side of the toner cartridge, after the mounting of the toner cartridge, next to the development device, into the main assembly of the image forming apparatus.

However, this handle, which is useful only for rotating the cylindrical toner cartridge, requires an image forming apparatus to have a space which it occupies while the toner cartridge is ready in the image forming apparatus to supply the development device with toner. Thus, the handle has been one of the hindrances to the effort to reduce the size of an image forming apparatus.

SUMMARY OF THE INVENTION

The primary object of the present invention is to provide an image formation unit into which a toner supply container can be more efficiently and easily mounted, and from which a toner supply container can be more efficiently and easily removed.

Another object of the present invention is to provide a toner supply container having a handle which adds very little to the size of the toner supply container.

Another object of the present invention is to provide an image forming apparatus capable of preventing toner from scattering while an image formation unit is mounted into, or removed from, the main assembly of the image forming apparatus.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 21 is a control table for determining the hook position based on the state of the switch for detecting the opening or closing of the covers, and the state of the photosensor for detecting the position of the toner container.

DETAILED DESCRIPTION OF THE PREFERRED EMBODIMENTS

Next, the image forming apparatus in the first embodiment of the present invention, which employs a process cartridge as a processing unit, will be described with reference to the appended drawings.

Embodiment 1

(General Structure)

Figure 1:
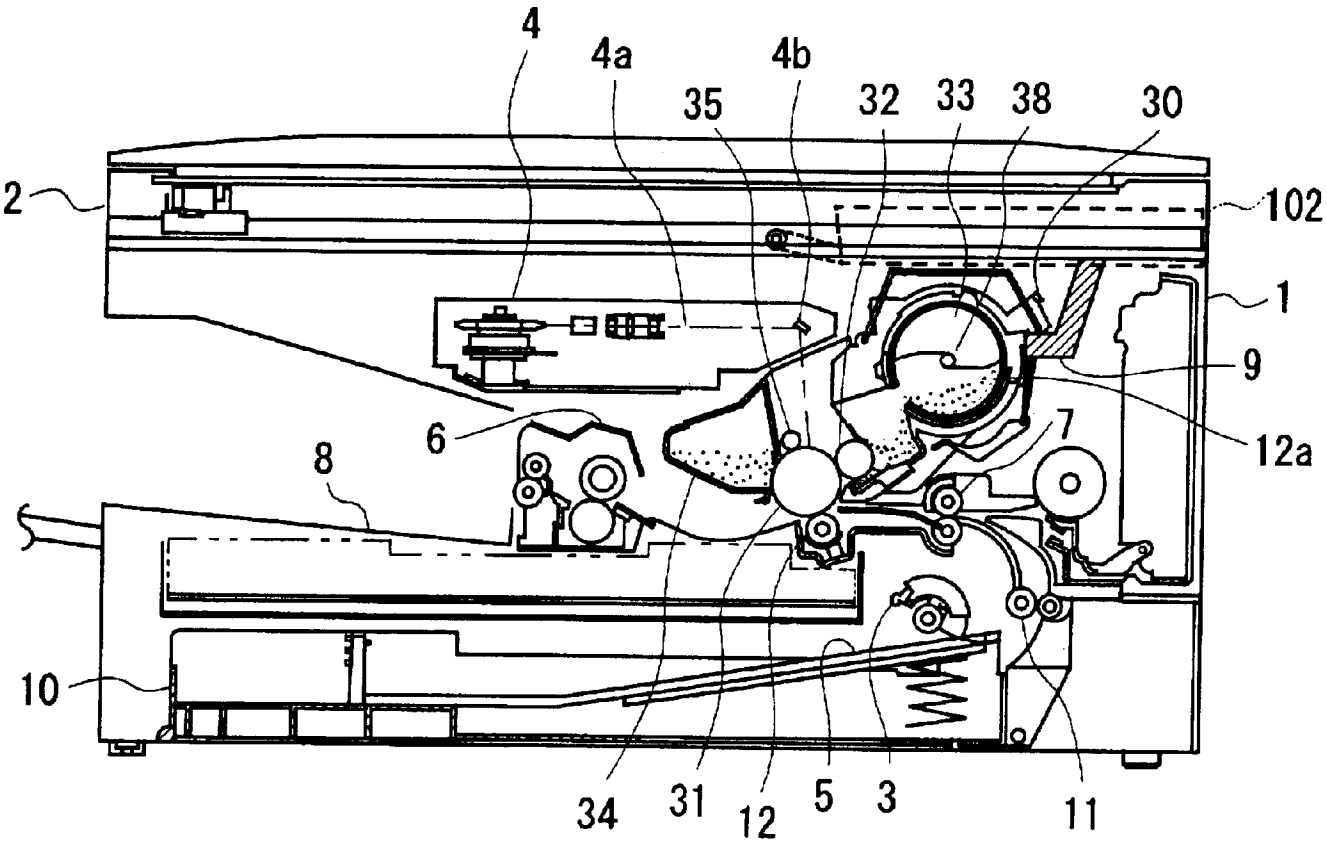
FIG. 1 is a sectional view of an image forming apparatus, describing the structure thereof.
Figure 2:
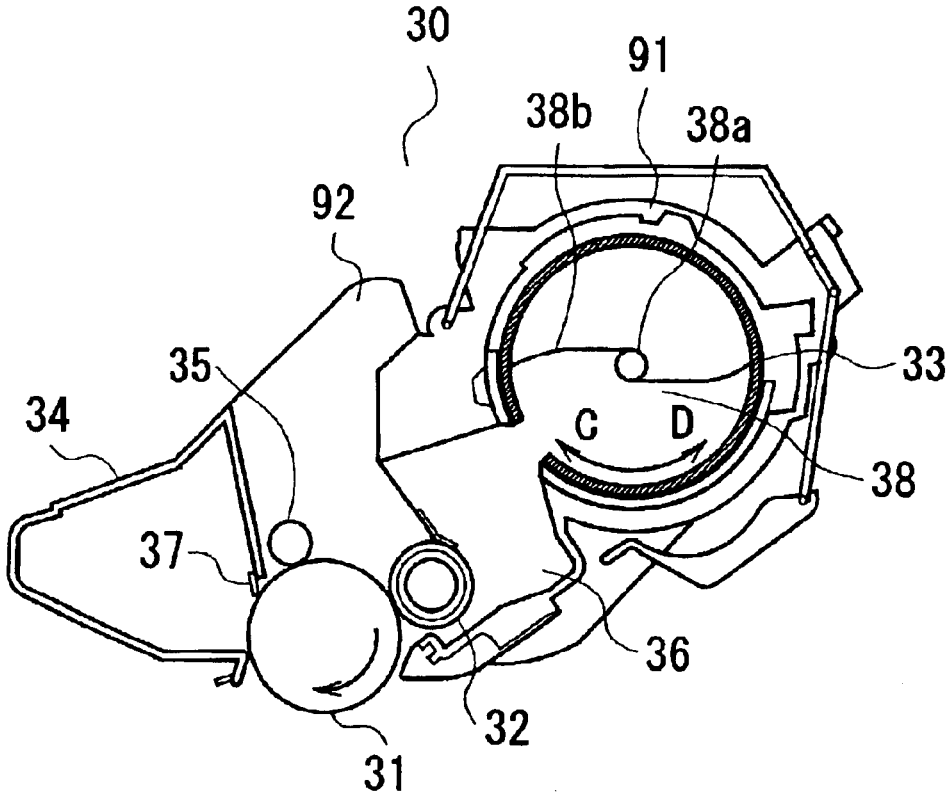
FIG. 2 is a sectional view of the essential portion of the process cartridge employed by the image forming apparatus in FIG. 1, describing the structure thereof.
Figure 3:
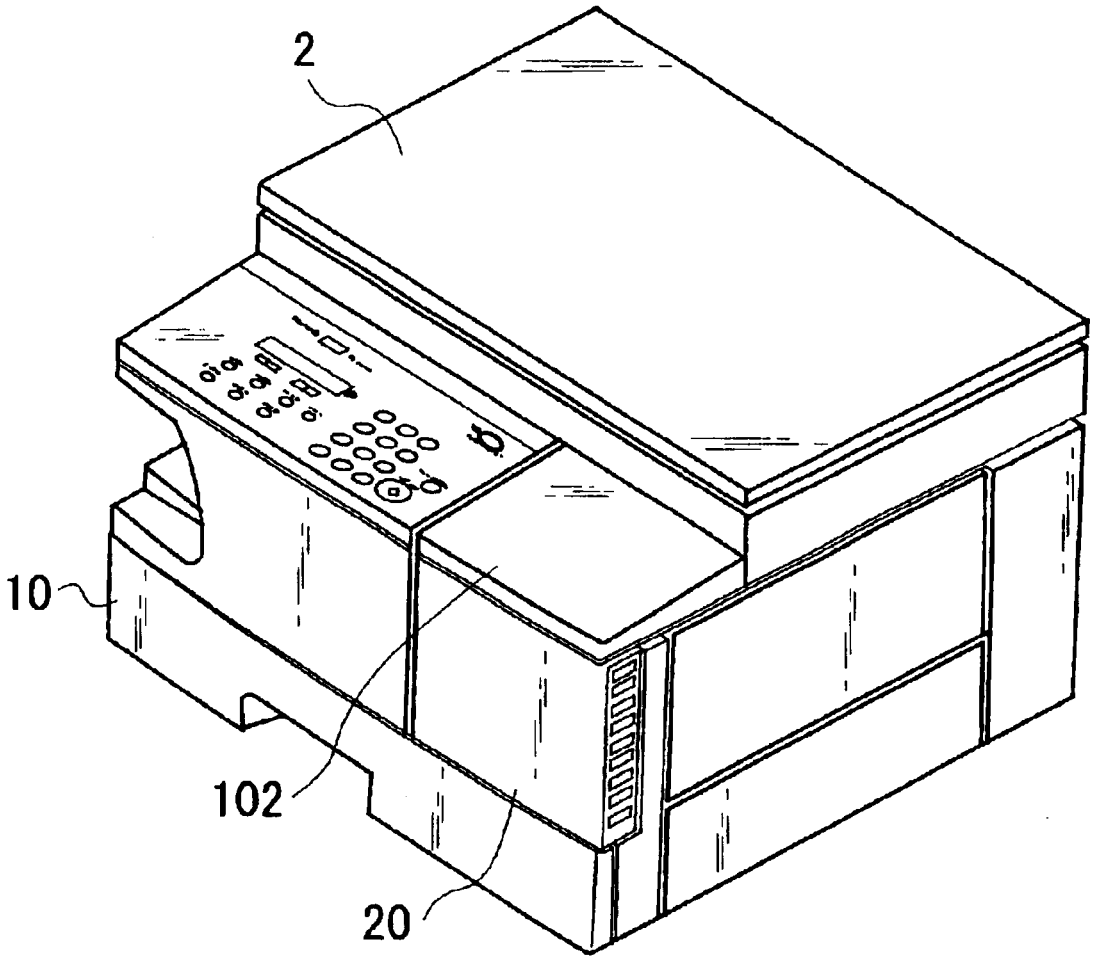
FIG. 3 is a perspective view of the image forming apparatus in FIG. 1.
Figure 4:
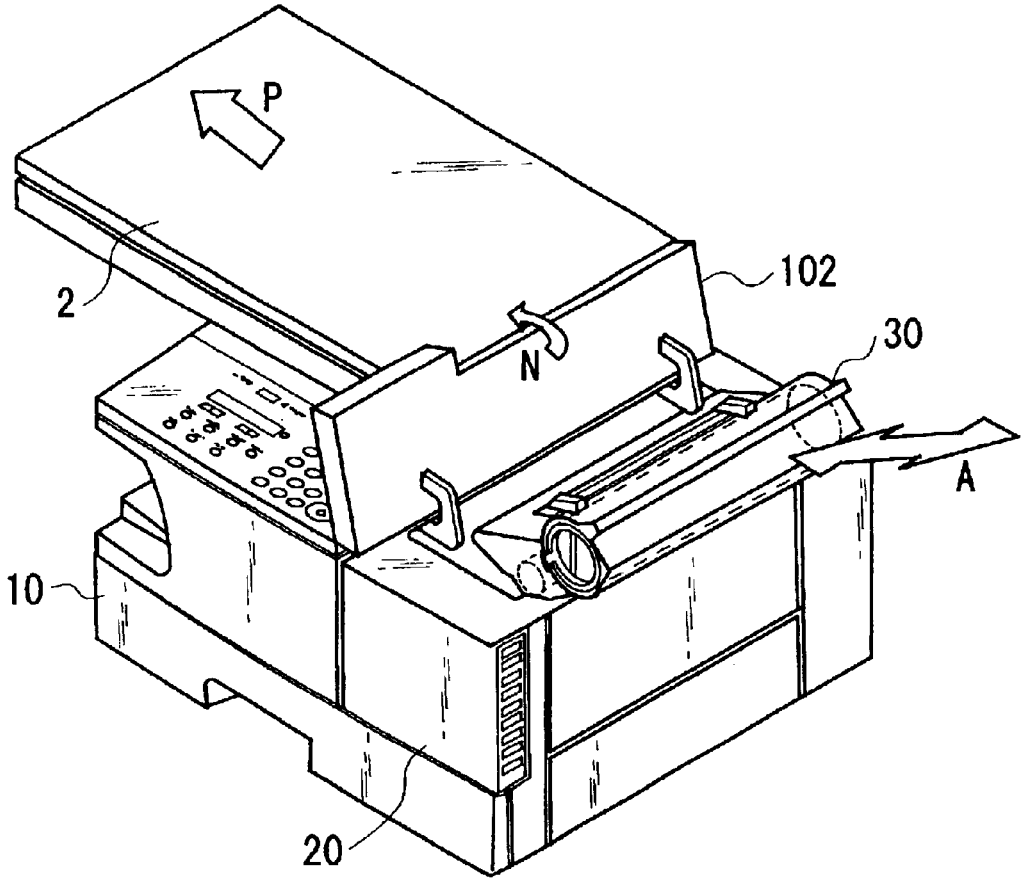
FIG. 4 is a perspective view of the combination of the image forming apparatus and process cartridge, showing how the process cartridge is mounted into, or removed from, the image forming apparatus.
Figure 5:
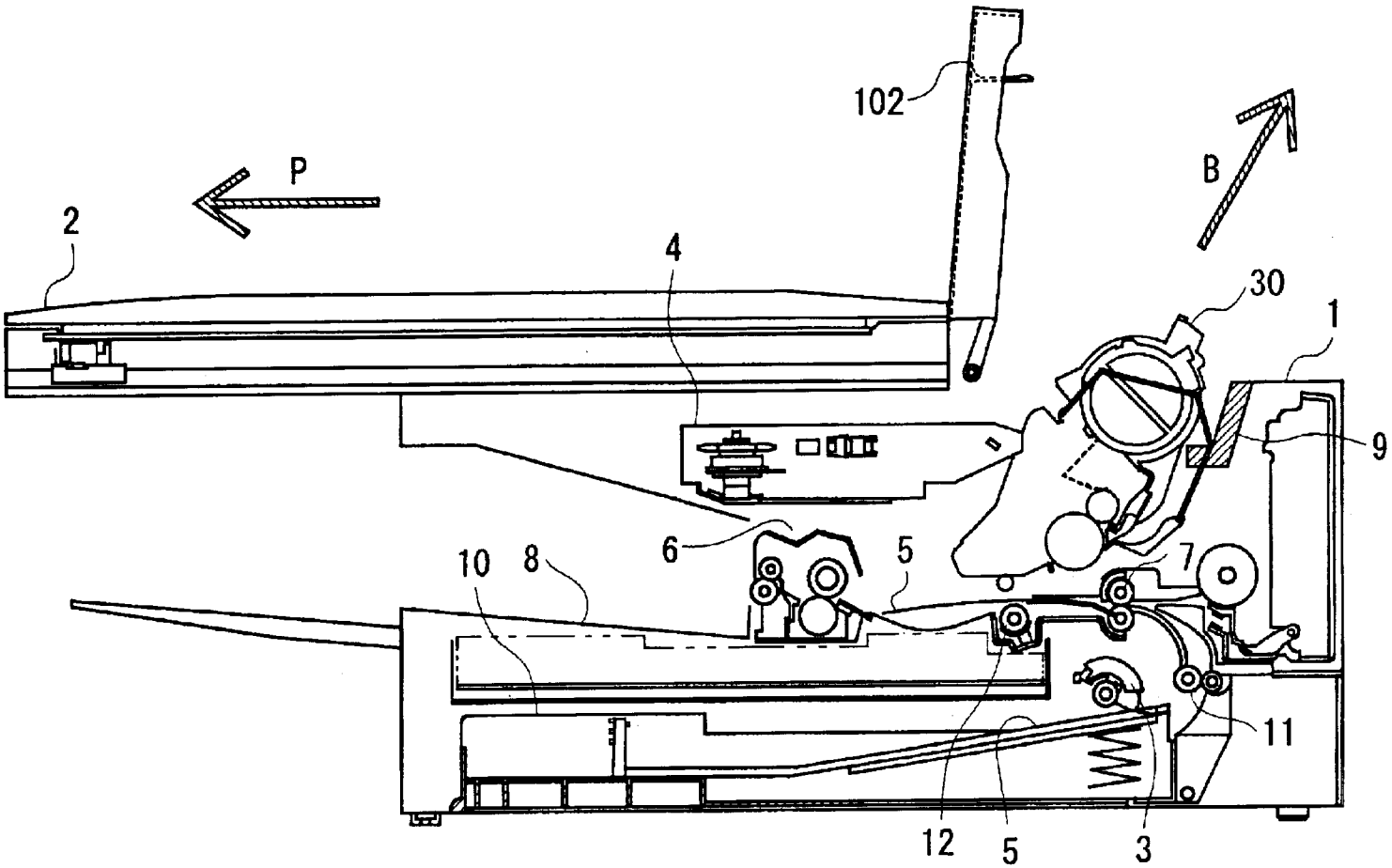
FIG. 5 is a sectional view of the combination of the image forming apparatus and process cartridge, showing how the process cartridge is mounted into, or removed from, the image forming apparatus.
Figure 6:
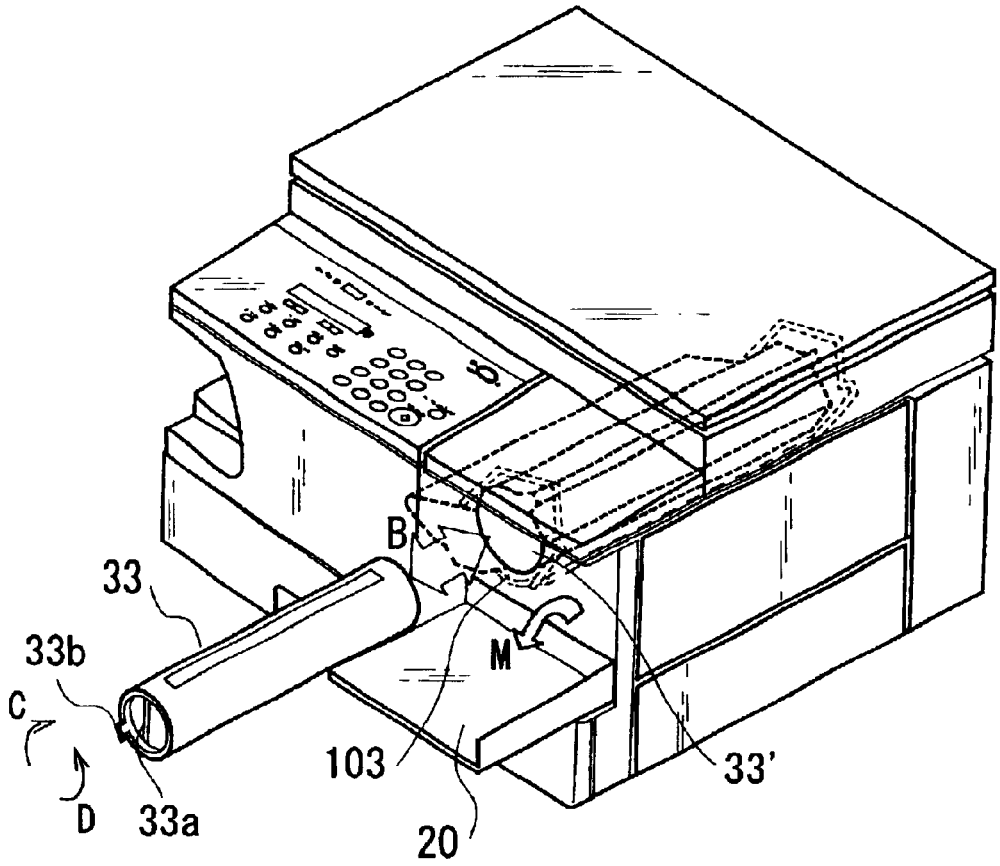
FIG. 6 is a perspective view of the combination of the image forming apparatus and a toner container, showing how the toner container is mounted into, or removed from, the image forming apparatus.

First, referring to FIGS. 1–6, the general structure of the image forming apparatus will be described. FIG. 1 is a sectional drawing for describing the image forming apparatus, and FIG. 2 is a sectional drawing for describing the essential portion of the process cartridge employed by the image forming apparatus. FIG. 3 is a perspective drawing for describing the image forming apparatus, and FIG. 4 is a perspective drawing for describing how the process cartridge is mounted into, or removed from, the image forming apparatus. FIG. 5 is a sectional drawing for describing how the process cartridge, as an image formation unit, is mounted into, or removed from, the image forming apparatus, and FIG. 6 is a perspective drawing describing how the toner container is mounted into, or removed from, the image forming apparatus.

Referring to FIG. 1, there are disposed an original reading portion 2, a laser scanner 4, a process cartridge, and a sheet feeding cassette 10, in the main assembly 1 of the image forming apparatus. The original reading portion 2 comprises: an original placement platen on which an original is placed; an image sensor, etc., which project a beam of light onto an original, and convert the light reflected by the original into digital signals. The process cartridge 30 constitutes an image forming portion as an image forming means, and comprises: a photoconductive drum 31 as an image bearing member, a development sleeve 32 as a developing means, a charge roller 35 as a charging means, a cleaning blade 37 as a cleaning means, etc., which are integrally disposed in the process cartridge 30. The sheet feeding cassette 10 contains a plurality of sheets of recording media 5 of a predetermined size.

First, the operation of this image forming apparatus will be described. While the information read from an original is converted into digital signals, recording sheets 5 as recording medium in the sheet feeding cassette 10 are fed out of the sheet feeding cassette 10 into the main assembly of the image forming apparatus. Then, the recording sheets 5 are sent to a pair of registration rollers 7 by the combination of a sheet conveyance roller 11, and another sheet conveyance roller which is smaller in diameter than the roller 11 and is rotated by the rotation of the sheet conveyance roller 11. The pair of registration rollers 7 are continuously rotated. As each recording sheet 5 is passed through the nip between the pair of registration rollers 7, the leading edge of the recording sheet 5 is detected by a sheet edge sensing means disposed on the downstream side of the pair of registration rollers 7 in terms of the recording sheet conveyance direction.

In response to the detection of the leading edge of the recording sheet 5 by the sheet edge sensing means, a beam of laser light is projected from the laser scanner 4 with a predetermined timing. The beam of laser light projected from the laser scanner 4 is deflected by a deflection mirror 4*b*, toward the peripheral surface of the photoconductive drum 31 in the process cartridge 30. Meanwhile, the photoconductive drum 31 is being rotated in the clockwise direction, and as the photoconductive drum 31 is rotated, the peripheral surface of the photoconductive drum 31 is uniformly charged by a primary charge roller 35 in the process cartridge 30. Thus, the uniformly charged peripheral surface of the photoconductive drum 31 is illuminated by the beam of laser light 4*a*.

As a result, an electrostatic latent image is formed on the uniformly charged portion of the photoconductive drum 31, starting from the downstream side in terms of the rotational direction of the photoconductive drum 31. This electrostatic static latent image is developed into a visible image by the developing means. More specifically, the toner 12*a* in a toner container 33 falls into a developing means container, and is sent into a development chamber 36 by a toner conveying means 38 comprising a shaft 38*a* and a pair of sheets 38*b* of Mylar, that is, elastic members. In the development chamber 36, the toner is conveyed to the peripheral surface of the photoconductive drum 31 by way of the development sleeve 32; the toner is electrically adhered to the various points of the peripheral surface of the photoconductive drum 31, which have not been exposed to the beam of laser light 4*a*. As a result, a visible image is formed of toner, on the peripheral surface of the photoconductive drum 31.

Meanwhile, in synchronism with the formation of the toner image on the photoconductive drum 31, the recording sheet 5 is sent to the contact area (sheet nipping portion) between the photoconductive drum 31 and a transfer roller 12 by the rotating pair of registration rollers 7, and the toner image on the peripheral surface of the photoconductive drum 31 is continuously transferred onto the recording sheet 5, starting from the downstream side. The portion of toner which remained on the peripheral surface of the photoconductive drum 31 without being transferred onto the recording sheet 5 is scraped down by the cleaning blade 37, and is collected in a waste toner bin 34 provided in the process cartridge 30.

After the transfer of the toner image onto the recording sheet 5, the recording sheet 5 is sent to a fixing apparatus 6 along a conveyance guide disposed roughly parallel to the plane of the contact area (sheet nipping portion) between the photoconductive drum 31 and transfer roller 12. Thereafter, the recording sheet 5 is accumulated in the delivery tray 8.

Referring to FIGS. 4 and 5, the image forming apparatus main assembly 1 is structured so that the above described process cartridge 30 is mounted into a mounting means 9 of the image forming apparatus main assembly 1, and that if the recording sheet 5 jams, or in the like situation, the process cartridge 30 can be removed from the image forming apparatus main assembly 1 by opening the process cartridge cover 102 after sliding the original reading portion 2 to the side.

Referring to FIG. 2, the process cartridge 30 comprises a development cartridge 91 and a drum cartridge (photoconductive member cartridge) 92, which can be separated or joined. The development cartridge 91 comprises a toner container 33, as a toner supply container, in which the toner 12*a* is contained, and which is removably mountable in the development cartridge 91. In consideration of the structural simplicity in the toner container itself and also the cost and structural simplicity in the mechanism for removably mounting the toner container 33 into the development cartridge 91, a cylindrical shape is generally used as the shape for the toner container 33. The process cartridge 30, toner container 33, and image forming apparatus main assembly 1 are structured so that the process cartridge 30 can be removably mounted in the image forming apparatus main assembly, with the toner container 33 in the process cartridge 30.

Referring to FIG. 6, as a cover 20 of the main assembly 1 for supplying toner (which hereinafter will be referred to as toner container cover) is opened, a toner container replacement hole 103 of the apparatus main assembly 1 is exposed, through which the toner container 33 can be mounted into, or removed from, the toner container holding space 33', as a toner container mounting means, of the process cartridge 30.

(Structure of Mechanism for Opening or Closing Process Cartridge Cover and Toner Container Cover)

Figure 7:
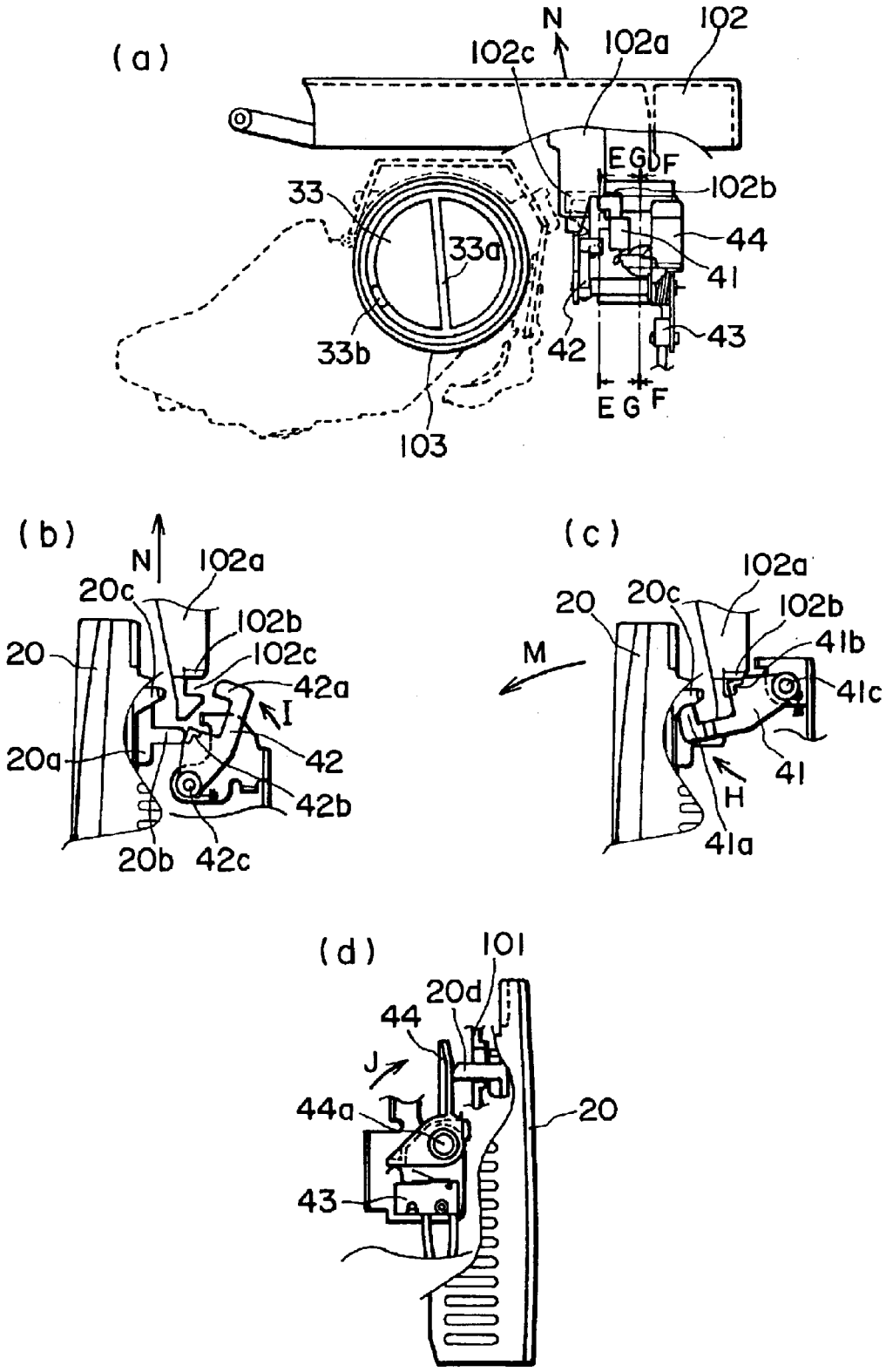
FIGS. 7(*a*), 7(*b*), 7(*c*) and 7(*d*) are schematic drawings of the mechanism for opening or closing the covers of the main assembly of the image forming apparatus, showing the structure thereof.
Figure 8:
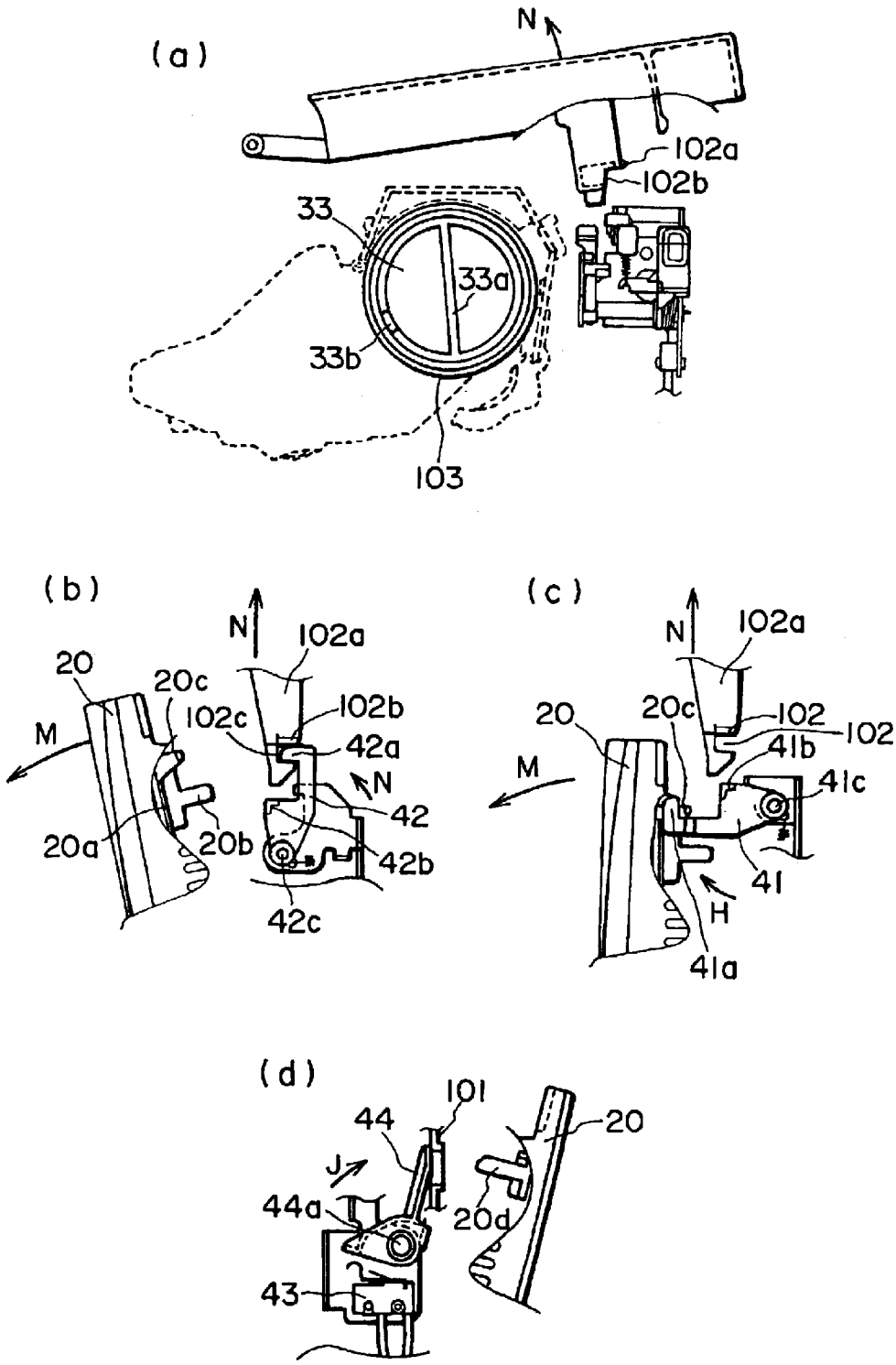
FIGS. 8(*a*), 8(*b*), 8(*c*) and 8(*d*) are schematic drawings of the mechanism for opening or closing the cover of the main assembly of the image forming apparatus, showing the structure thereof
Figure 9:
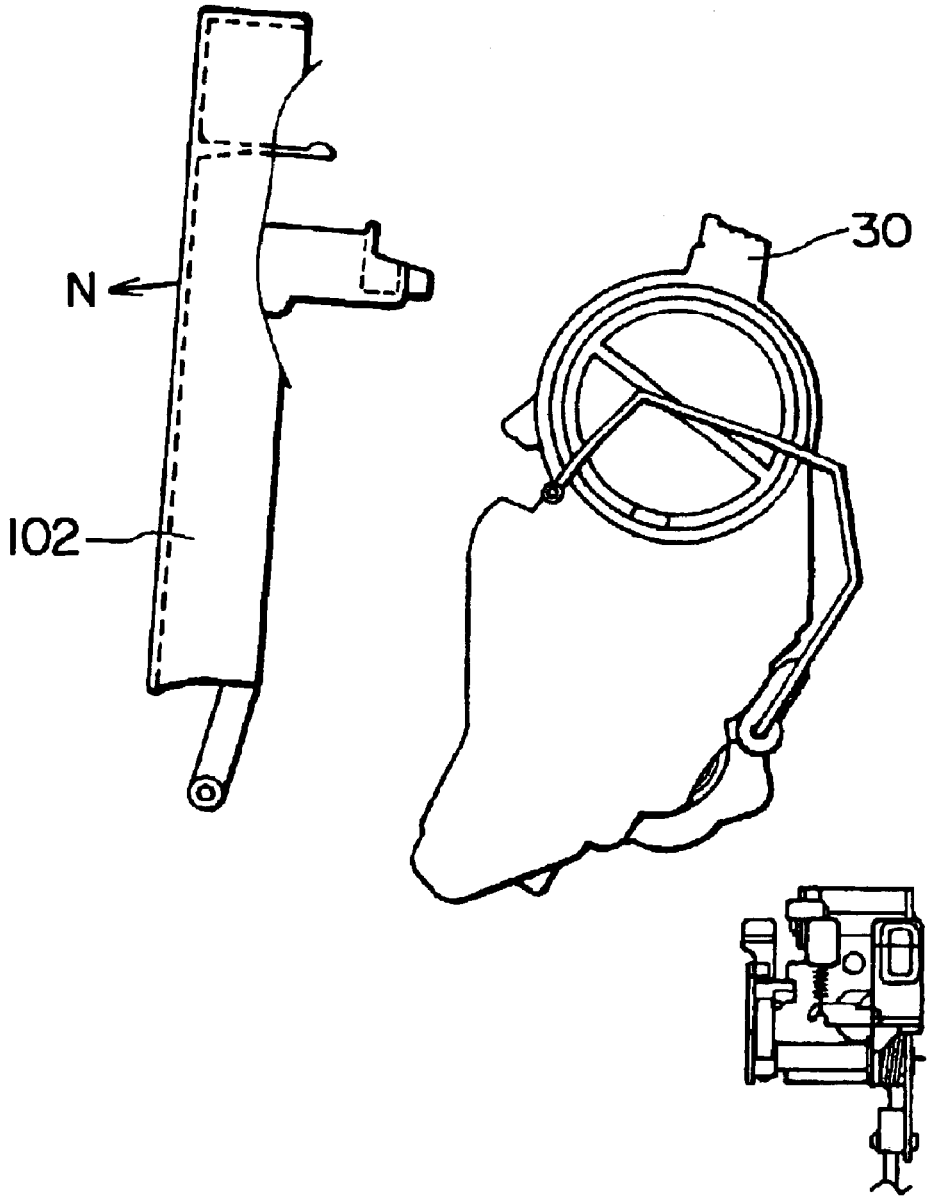
FIG. 9 is a phantom view of the mechanism for opening or closing the covers of the main assembly of the image forming apparatus, showing the state of the mechanism in which the cover for the process cartridge is completely open.

Next, referring to FIGS. 7–12, the structure of the mechanism for opening or closing the toner cartridge cover (first door) 20, that is, the cover for the toner supplying opening, and a process cartridge cover (second door) 102, will be described. FIGS. 7 and 8 are drawings for describing the mechanism for opening or closing the covers. In each drawing, (a) is a phantom view of the mechanism for opening or closing the covers; (b) is a sectional view of the mechanism, at a plane E—E in (a); (c) is a sectional view of the mechanism, at a plane F—F in (a); (d) is a sectional view of the mechanism, at a plane G—G in (a). FIG. 9 is a phantom drawing of the process cartridge cover, which is fully open. FIGS. 10–15 are drawings for showing how the covers are opened or closed. In each of FIGS. 10–15, (a) is a phantom front view of the toner container detecting mechanism; (b) is a phantom side view of the toner container detecting mechanism, as seen diagonally above the right side of the apparatus; and (c) is a phantom top view of the toner container detecting mechanism.

The process cartridge cover 102 is provided with a projection 102*a*, which is provided with a projection prop 102*b* and a slot 102*c*. On the other hand, the toner cartridge cover 20, that is, the cover for the toner supplying opening, is provided with a projection 20*a*, which is provided with a projection prop 20*b*, a slot 20*c*, a projection prop 20*d*, a hook prop 20*e*, a hook 20*f*, and a gear 20*g*.

Referring to FIGS. 7 and 8, there are hooks 41 and 42 which are rotatable about rotational axes 41*c* and 42*c*, respectively, and which are kept pressured toward the directions indicated by arrow marks H and I, respectively, by unshown springs. The hooks 41 and 42 are provided with hook props 41*a* and 42*a*, respectively, and projections 41*b* and 42*b*, respectively.

Also referring to FIGS. 7 and 8, designated by a referential numeral 43 is a detection switch for detecting the opening or closing of the toner cartridge cover 20, and designated by a referential numeral 44 is a detection lever for turning on or off the detection switch 43 as the toner cartridge cover 20 is opened or closed. The detection lever 44 is rotatable about the rotational axis 44*a*, and is kept pressured in the direction indicated by an arrow mark J by an unshown spring. Designated by a referential numeral 101 is an interior cover of the image forming apparatus main assembly, which also constitutes the front panel of the image forming apparatus main assembly.

Figure 10:
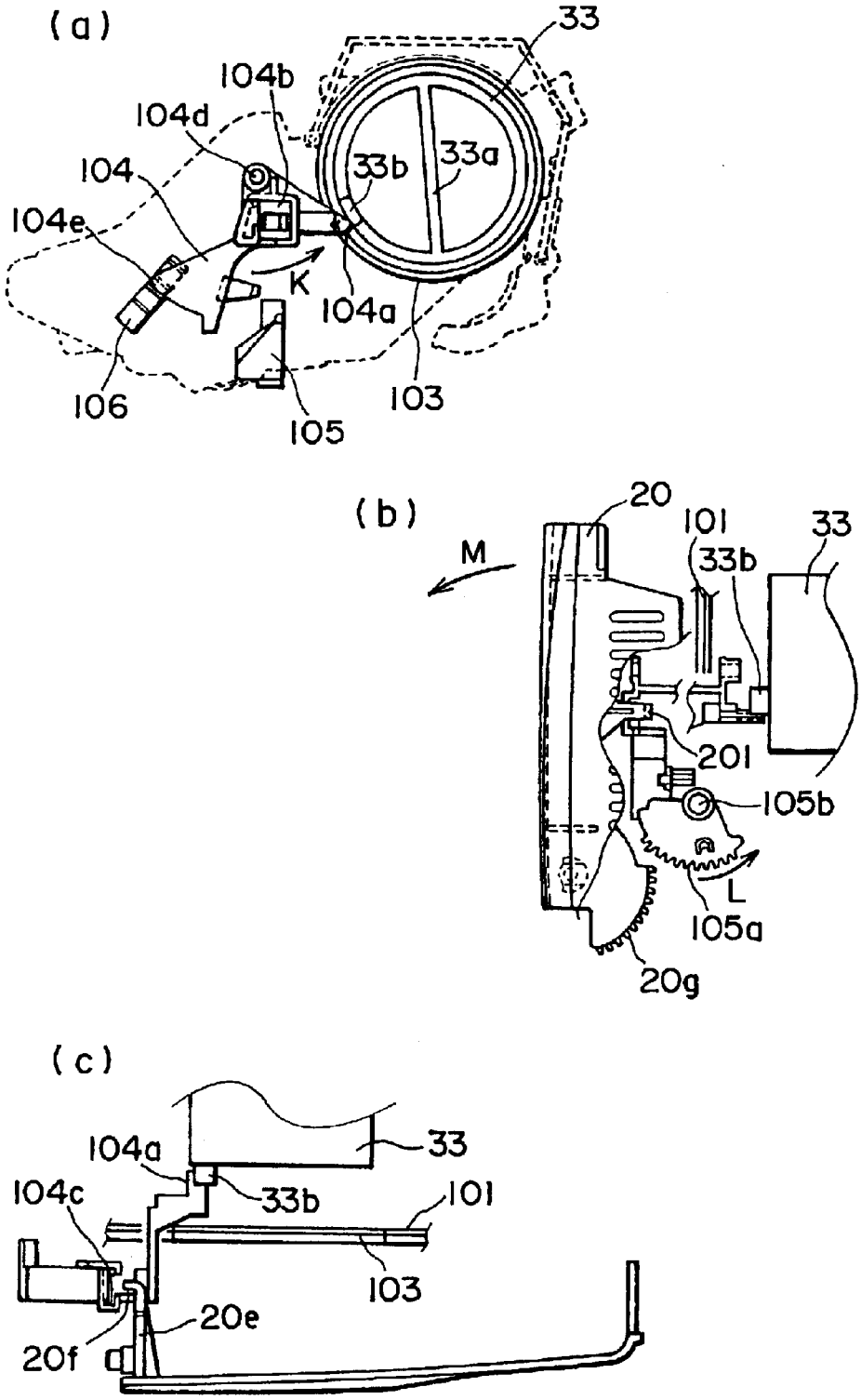
FIGS. 10(*a*), 10(*b*) and 10(*c*) are drawings which show the opening or closing of the covers, in which 10(*a*) is a phantom front view of the toner container detecting mechanism; 10(*b*) is a phantom side view of the toner container detecting mechanism, as seen diagonally above the right side of the apparatus; and 10(*c*) is a phantom top view of the toner container detecting mechanism.

Referring to FIG. 10(*a*), a toner container detection lever 104, which is rotatable about the rotational axis 104*d*, is kept pressured in the direction indicated by an arrow mark K by an unshown spring. This toner container detection lever 104 is provided with a projection 104*a*, a hole 104*b* into which hook prop 20*e* engages, and a recess 104*c* (FIG. 10(*c*)) into which the hook 20*f* locks.

Next, referring to FIG. 10(*b*), there is a lever retraction cam 105, which has a gear 105*a*, and is rotatable about the rotational axis 105*b*. This lever retraction cam 105 is kept pressured in the direction indicated by an arrow mark L by an unshown spring. Further, there is a photosensor 106 for detecting whether or not the toner container 33 is in the toner supplying position.

(Operation of Mechanism for Opening or Closing Covers during Mounting of Process Cartridge)

The state of the mechanism for opening or closing the process cartridge cover 102 and toner container cover 20 will be described regarding when the process cartridge 30 is in the proper position in the apparatus main assembly 1, that is, when the apparatus is normally operating or on standby.

Referring to FIGS. 7 and 8, after the process cartridge 30 is properly mounted in the apparatus main assembly 1, the process cartridge cover 102 remains closed. Therefore, the projection 41*b* of the hook 41 is kept pressed by the projection prop 102*b* of the projection 102*a*. As a result, the hook p prop 41*a* of the hook 41 is kept away from the slot 20*c* (FIG. 7(*c*)).

Further, the toner container 33 is in the position in which it can supply toner. Therefore, the projection 104*a* of the toner container detection lever 104 is kept pressed by the projection 33*b* (FIG. 6) of the toner container 33, allowing the hook prop 20*e* to pass the hole 104*b*. Therefore, the toner container cover 20 can be opened in the direction indicated by an arrow mark M in FIG. 7(*c*).

Further, a flag 104*e* is blocking the light path of a photosensor 106. Therefore, it is confirmed that the toner container 33 is in the position in which the toner container 33 can supply toner (FIG. 10).

On the other hand, the toner container cover 20, that is, the cover for the toner supplying opening, is also in the closed position. Therefore, the projection 42*b* of the hook 42 is kept pressed by the projection prop 20*b* of the projection 20*a*. As a result, the hook prop 42*a* is kept away from the anchor 102*c*.

Therefore, the process cartridge cover 102 can be opened in the direction indicated by an arrow mark N in FIGS. 7(*a*) and 7(*b*).

Further, the projection 20*d* is put through the hole of the interior cover 101, and the detection switch 43 is kept in the ON-state by the detection lever 44 which is kept pressured by the projection 20*d*. Therefore, it is confirmed that the toner container cover 20 is in the closed position.

(Operation of Mechanism for Opening or Closing Covers during Removal of Process Cartridge)

Next, referring to FIGS. 8–15, the movement of the mechanism which occurs when the process cartridge 30 is removed from the image forming apparatus main assembly 1 as the recording sheet 5 jams the apparatus, or in the like situation, will be described.

If the recording sheet 5 gets stuck in the image forming apparatus during an image forming operation, the following steps are to be taken. First, the process cartridge cover 102, which is covering the process cartridge 30, is to be exposed by sliding the original reading portion 2 in the direction indicated by an arrow mark P in FIG. 4 or 5. Then, the process cartridge cover 102 is to be opened in the direction of the arrow mark N, and then, the process cartridge 30 is to be removed in the direction of the arrow mark A from the opening exposed by the opening of the process cartridge cover 102. Then, the jammed recording sheet 5 is to be removed in the same direction as the direction in which the recording medium 5 is conveyed (direction perpendicular to rotational axis of photoconductive drum 31) so that the jammed recording sheet 5 can be smoothly removed.

There is provided a regulating means (first cover regulating means) for preventing the accident that the toner container cover 20, that is, the cover for the toner supplying opening, opens while the process cartridge cover 102 is open. More specifically, as the process cartridge cover 102 is opened, the projection 102*b* is moved away from the projection 41*b*, allowing the hook prop 41*a* to be inserted into the notch 20*c* by the pressure from the spring. Therefore, even if an attempt is made to open the toner container cover 20 in the direction of the arrow mark M, the hook prop 41*a* engaged in the notch 20*c* of the toner container cover 20 prevents the toner container cover 20 from being opened (FIGS. 8(*a*) and 8(*c*)).

Figure 11:
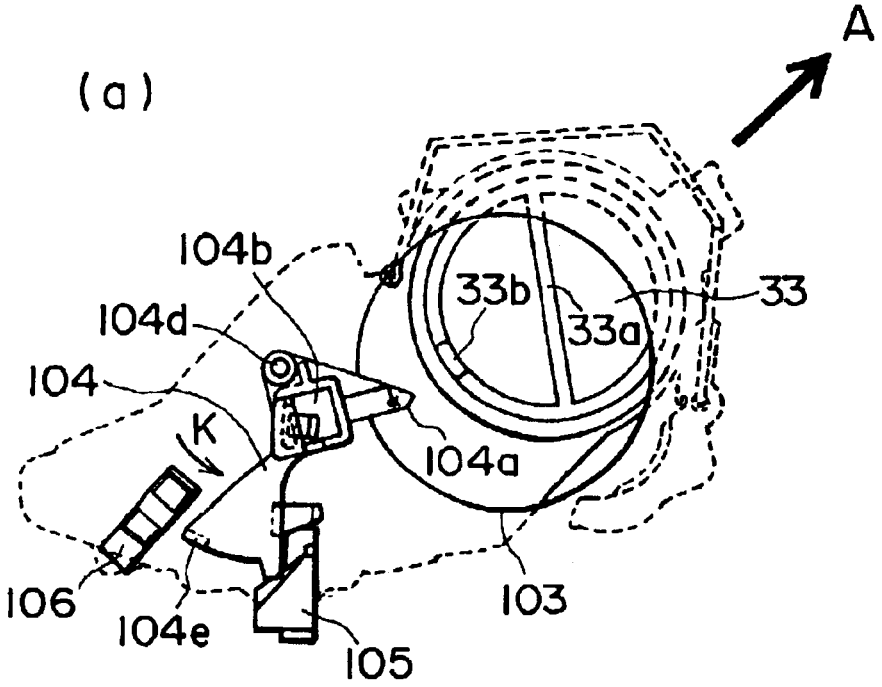
FIGS. 11(*a*) and 11(*b*) are drawings which show the opening or closing of the covers, in which 11(*a*) is a phantom front view of the toner container detecting mechanism; and 11(*b*) is a phantom top view of the toner container detecting mechanism.
Figure 11:
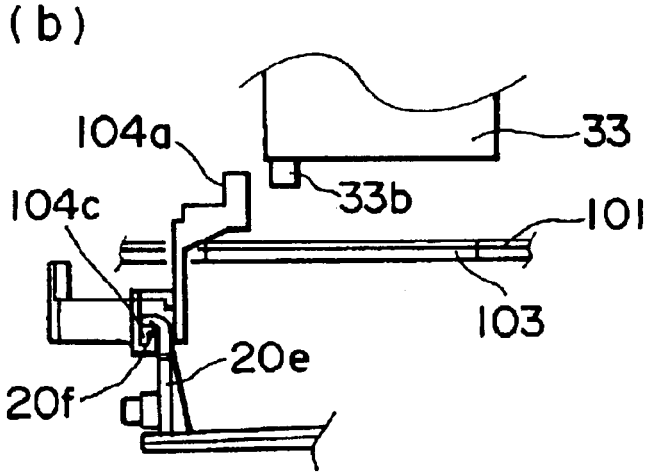
Figure 12:
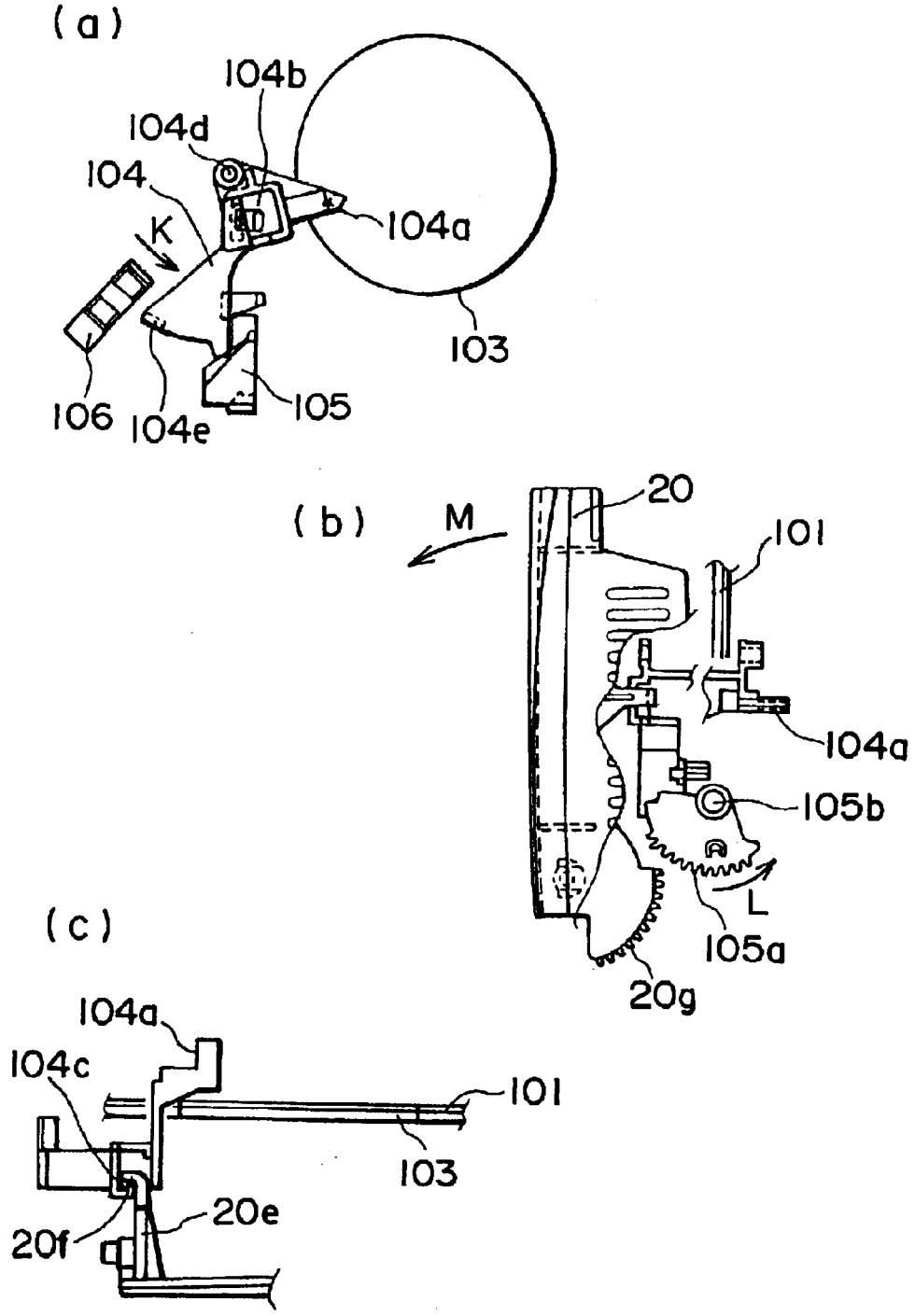
FIGS. 12(*a*), 12(*b*) and 12(*c*) are drawings which show the opening or closing of the covers, in which 12(*a*) is a phantom front view of the toner container detecting mechanism; 12(*b*) is a phantom side view of the toner container detecting mechanism, as seen diagonally above the right side of the apparatus; and 12(*c*) is a phantom top view of the toner container detecting mechanism.

Next, referring to FIG. 11, as the process cartridge 30 is removed from the apparatus main assembly 1, the projection 33*b* of the toner container 33 is moved away from the projection 104*a* of the toner container detection lever 104, allowing the toner container detection lever 104 to be rotated in the direction of the arrow mark K by the pressure from the spring, until the recess 104*c* of the lever 104 opposes the hook prop 20*e* of the toner container cover 20 (in this embodiment, lever comes into contact with lever retraction cam 105). Further, the flag 104*e* is moved out of the light path of the photosensor 106. Therefore, it is confirmed that the toner container 33 is out of the toner supplying position.

As the process cartridge cover 102 is closed while the apparatus main assembly is in the above described state, the relationship among the process cartridge cover 102, toner container cover 20, and hook 41 is restored to the state shown in FIG. 7(*c*). However, the process cartridge 30 is not in the apparatus main assembly, and therefore, the portion with recess 104*c* interferes with the hook prop 20*e*. Thus, even if an attempt is made to open the toner container cover 20 in the direction of the arrow mark M, the toner container cover 20 cannot be opened (FIG. 12(*c*)).

Further, the flag 104*e* is not in the light path of the photosensor 106. Therefore, the apparatus main assembly is informed that the toner container 33 is not in the toner supplying position. Therefore, the apparatus main assembly does not become operable for image formation (FIGS. 12(*a*) and 12(*c*)).

However, as soon as the process cartridge 30 is returned into the apparatus main assembly, the apparatus main assembly recovers to the standby state shown in FIGS. 7 and 10.

(Operation of Mechanism for Opening or Closing Covers during Exchanging of Toner Container)

Next, referring to FIGS. 6, 8, and 13–15, the operation of the mechanism for opening or closing the covers 102 and 20 when the toner container 33 is replaced to supply the development device with toner will be described.

In order to replace the toner container 33, the following steps are to be followed. First, the handle 33*a* of the toner container 33 must be exposed by opening the toner container cover 20, that is, the cover for the toner supplying opening, in the direction of the arrow mark M in FIG. 6. Then, in order to free the development device, the toner container 33 is to be rotated in the direction of the arrow mark C in FIG. 6, by grasping the handle 33*a*. Next, the process cartridge 30 is to be extracted from the apparatus main assembly by sliding the toner container 33 toward the front side of the apparatus main assembly. During the extraction of the toner container 33, the opening of the toner container 33 is facing upward. Therefore, even if a certain amount of the toner is remaining in the toner container 33, it does not leak.

There is also provided a regulating means (second cover regulating means) for preventing the process cartridge cover 102 from opening while the toner container cover 20 is open. More specifically, as the toner container cover 20 is opened, the projection 20*a* is moved away from the projection 42*b* as shown FIG. 8(*b*). As a result, the hook prop 42*a* is inserted into the notch 102*c* by the pressure from the spring. Therefore, even if an attempt is made to open the toner container cover 20 in the direction of the arrow mark N in FIG. 8(*b*), the notch 102*c* keeps the hook prop 42*a* locked in place, preventing the process cartridge cover 102 from being opened.

Figure 13:
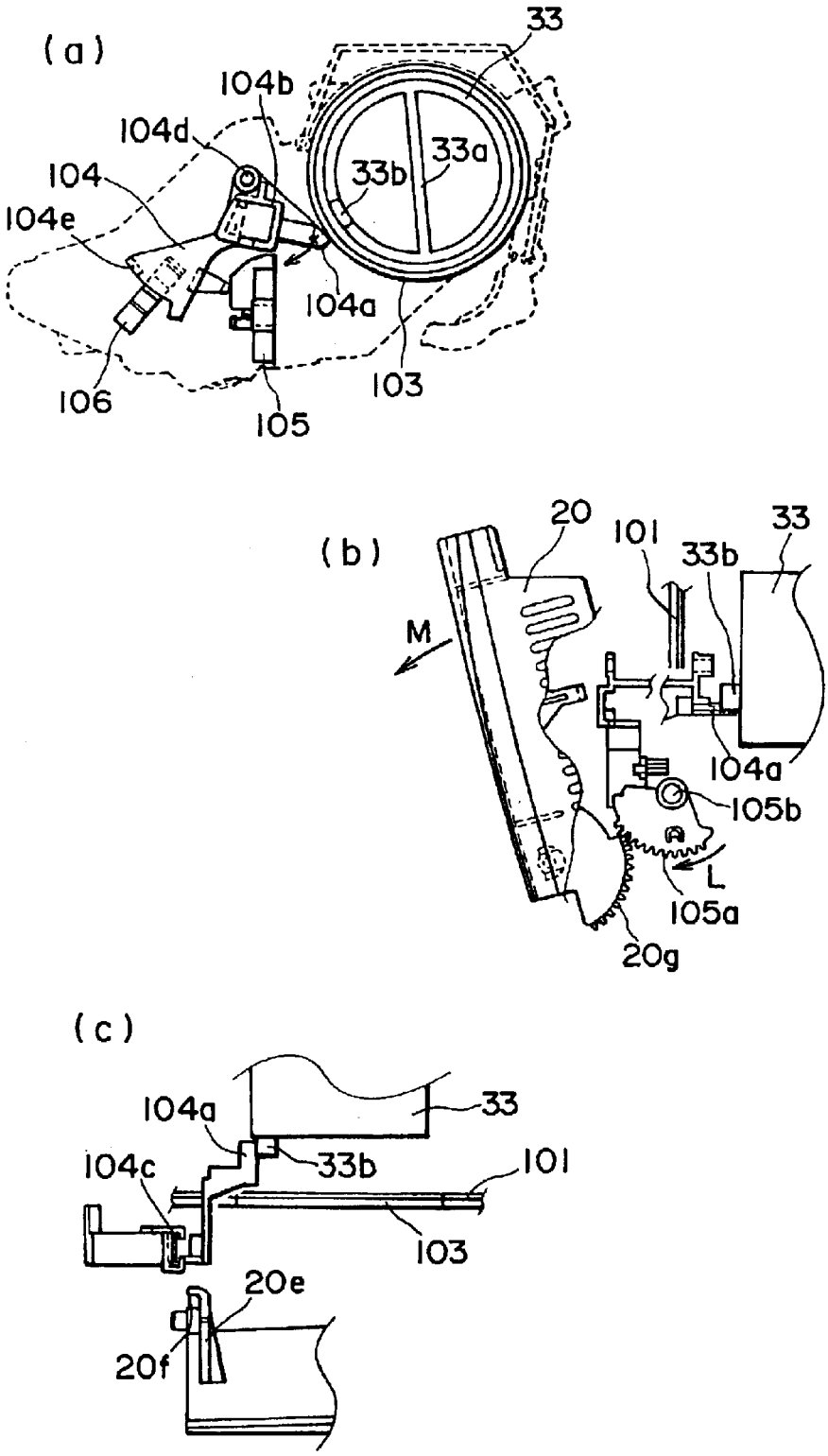
FIGS. 13(*a*), 13(*b*) and 13(*c*) are drawings which show the opening or closing of the covers, in which 13(*a*) is a phantom front view of the toner container detecting mechanism; 13(*b*) is a phantom side view of the toner container detecting mechanism, as seen diagonally above the right side of the apparatus; and 13(*c*) is a phantom top view of the toner container detecting mechanism.
Figure 14:
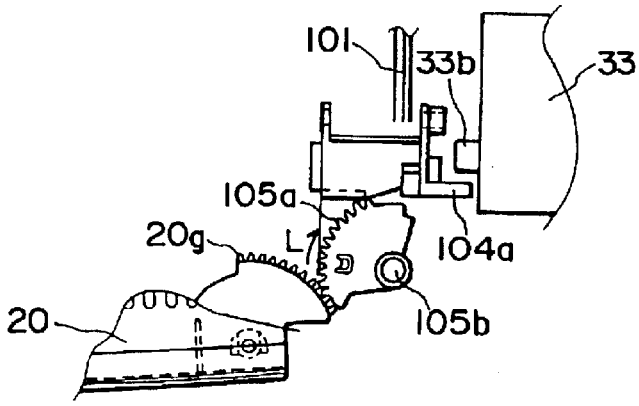
FIG. 14 is a phantom side view of the toner container detecting mechanism, as seen diagonally above the right side of the apparatus, showing the opening or closing of the covers.
Figure 15:
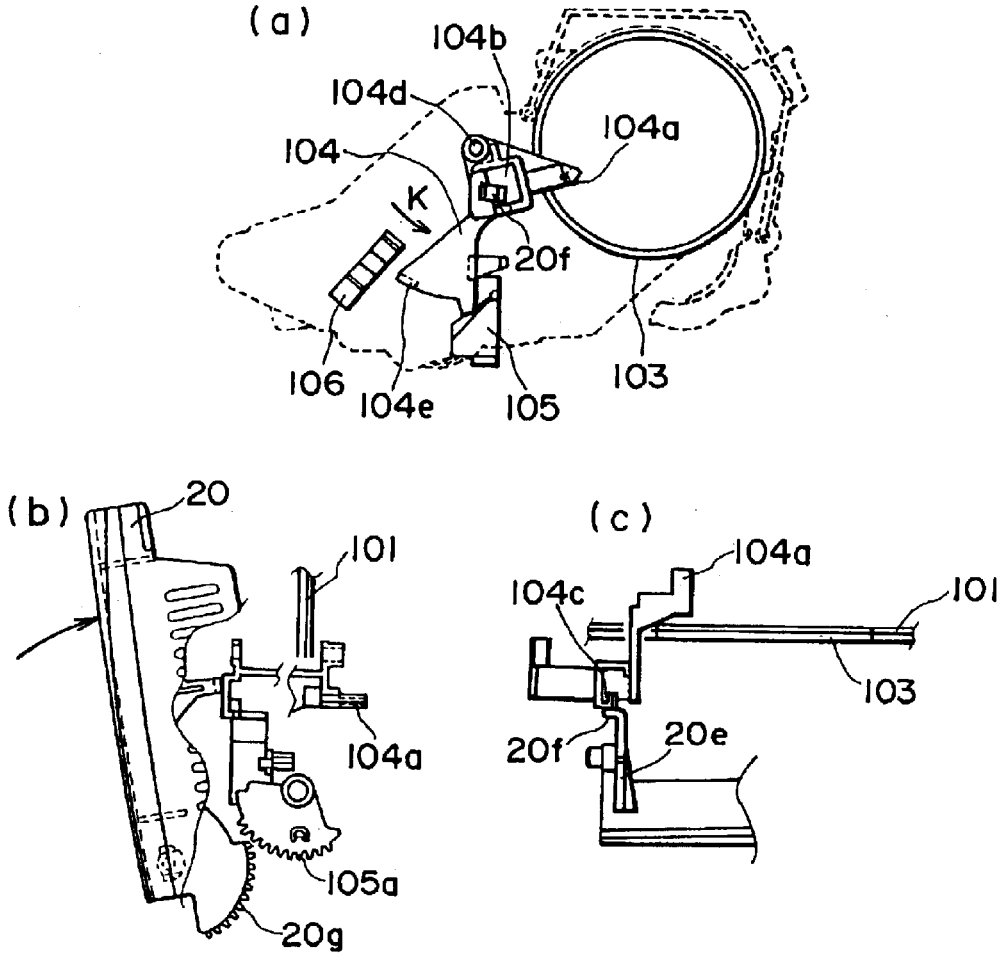
FIGS. 15(*a*), 15(*b*) and 15(*c*) are drawings which show the opening or closing of the covers, in which 15(*a*) is a phantom front view of the toner container detecting mechanism; 15(*b*) is a phantom side view of the toner container detecting mechanism, as seen diagonally above the right side of the apparatus; and 15(*c*) is a phantom top view of the toner container detecting mechanism.

Further, as the toner container cover 20 is opening in the direction of the arrow mark M to the position shown in FIG. 13(*b*), the gear 20*g* begins to mesh with the gear 105*a* of the lever retraction cam 105. As the toner container cover 20 is further opened to the position (at which toner container 33 can be extracted by sliding it toward from side) shown in FIG. 14, the lever retraction cam 105 is rotated in the direction of the arrow mark L while pushing the toner detection lever 104 back to the position shown in FIG. 13(*a*) so that the projection 104*a* does not interfere with the sliding of the toner container 33 toward front side.

The toner container cover 20, that is, the cover for the toner supplying opening, is provided with means for keeping the toner container cover 20 open while the toner container 33 is not in the position in which it can supply the developing means with toner. More concretely, if an attempt is made to close the toner container cover 20 while the toner container 33 is not in the apparatus main assembly, the following reaction occurs. That is, as the toner container cover 20 is closed to the position shown in FIG. 13(*b*), the toner container detection lever 104 is rotated in the direction of the arrow mark K (FIG. 10(*a*)) by the pressure from the spring, and stops at the point at which the front wall of the portion with the recess 104*c* opposes the hook 20*f* of the toner container cover 20 (in this embodiment, toner container detection lever 104 comes into contact with lever retraction earn 105). If an attempt is made to further close the toner container cover 20 from this point, the front wall of the portion with the recess 104*c* interferes with the hook 20*f*, preventing the toner container cover 20 from being closed.

Further, the projection 20*d* is moved away from the detection lever 44. Therefore, the detection switch 43 is in the Off-position, confirming that the toner container cover 20 is open (FIG. 8(*d*)).

When mounting the toner container 33 into the process cartridge 30, the above described steps to be followed to extract the toner container 33 from the process cartridge 30 are to be followed in reverse (after inserting the toner container 33 into the process cartridge 30 all the way to the deepest end shown in FIG. 2, an operator is to rotate the toner container 33 in the direction of the arrow mark D to align the toner outlet opening with the toner inlet opening of the development chamber 36). With the proper mounting of the toner container 33 into the process cartridge 30, the image forming apparatus recovers to the standby state shown in FIGS. 7 and 10.

As described above, with the provision of the above described structural arrangement, the direction in which the process cartridge 30 is inserted or extracted becomes roughly perpendicular to the axial line of the photoconductive drum 31. Therefore, it is assured that a sheet jam or the like is easily dealt with. Further, the direction in which the toner container 33 is inserted into, or extracted from, the development cartridge 91 is roughly parallel to the axial line of the photoconductive drum 31. Therefore, it is possible to replace the toner container 33 without removing the process cartridge 30 from the apparatus main assembly, improving thereby operational efficiency. Moreover, the provision of the above described structural arrangement prevents toner from scattering when mounting or dismounting the process cartridge 30.

Further, the above-described structural arrangement controls which cover or covers are allowed to be opened when supplying toner, dealing with a sheet jam, and exchanging the drum cartridge 92, in order to reduce the amount of the air flow in the apparatus main assembly. Therefore, the amount by which the toner is scattered during the mounting or removal of the process cartridge is minimized.

Further, the toner container cover 20 is prevented from being closed during the exchanging of the toner container 33. Therefore, a user is prevented from forgetting to insert a replacement toner cartridge (33).

Embodiment 2

Next, the second embodiment of the present invention will be described. Incidentally, the general structures of the image forming apparatus and process cartridge in this embodiment are the same as those in the first embodiment, and therefore, will not be described here to avoid the repetition of the same descriptions.

Figure 16:
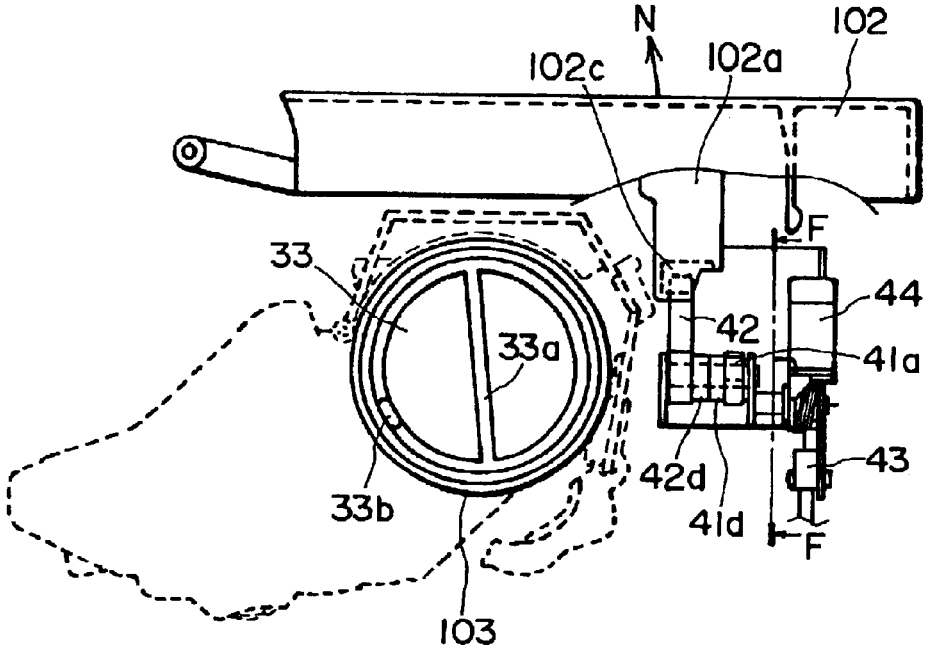
FIG. 16 is a phantom front view of the mechanism for opening or closing the covers of the image forming apparatus, showing the structure thereof FIGS. 17(*a*) and 17(*b*) are drawings which show the opening or closing of the cover for the process cartridge and the cover for the toner cartridge, in which 17(*a*) is a front view of the mechanism for opening or closing the covers, and 17(*b*) is a side view thereof.

FIG. 16 is a phantom front view of the mechanism, in the image forming apparatus, for opening or closing the covers of the image forming apparatus. FIGS. 17–20 are drawings for describing the relationship among the components of the mechanism in various stages of the opening or closing of the process cartridge cover 102 for process cartridge replacement and toner container cover 20 for toner container replacement. In each of the drawings, (a) is a front view of the mechanism, and (b) is a sectional view of the mechanism at a plane F—F in FIG. 16. FIG. 21 is a control table used for determining the hook position from the state of the photosensor of the cover position detection switch and the state of the toner container position detection switch.

Figure 17:
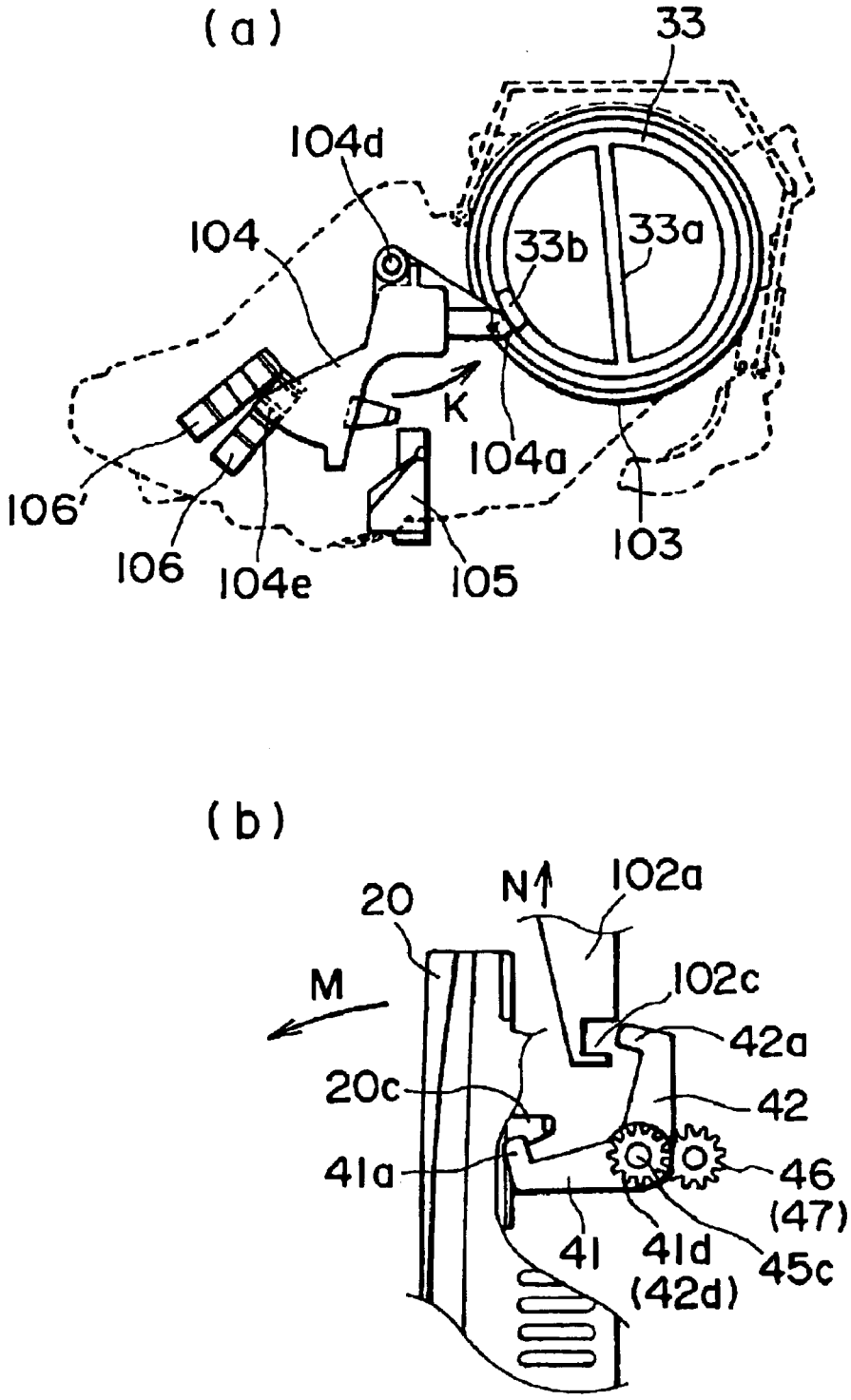

Referring to FIGS. 16 and 17, hooks 41 and 42 are provided with gears 41*d* and 42*d*, respectively, which are rotatable about the rotational axis 45*c*. These gears 41*d* and 42*d* are meshed with gears 46 and 47, respectively, connected to unshown stepping motors, one for one.

There is provided a switch (unshown) which is turned on or off by the opening or closing movement of the process cartridge cover 102, like the switch 43 which is turned on or off by the opening or closing movement of the toner container cover 20. There is also provided a photosensor 106' for detecting whether or not the toner container cover 20 is in the position in which the toner container cover 20 allows the toner container 33 to be slid toward the front side to be extracted. Otherwise, the structural arrangement in this embodiment is similar to that in the first embodiment, and the components, portions, etc., which are identical in function to those in the first embodiment, will be given the same referential symbols as those given in the first embodiment.

(Operation of Mechanism for Opening or Closing Covers during Mounting of Process Cartridge)

First, referring to FIGS. 16 and 17, the state of the mechanism while the image forming apparatus is operating normally or while it is on standby will be described.

While the image forming apparatus is operating normally or while it is on standby, the process cartridge cover 102 and toner container cover 20 are in the closed positions. Therefore, the switch (unshown) for detecting the opening or closing of the process cartridge cover 102, and the switch 43 for detecting the opening or closing of the toner container cover 20, are both in the ON-state, whereas the photosensor 106' is in the OFF-state.

Further, the toner container 33 is in the position in which it is capable of supplying toner. Therefore, the projection 104*a* of the toner container detection lever 104 is kept pressed by the projection 33*b* of the toner container 33. Therefore, the flag 104*e* is positioned in the light path of the photosensor 106, keeping thereby the photosensor 106 in the ON-state.

Thus, the hooks 41 and 42 are kept in the open position. In other words, the hook props 41*a* and 42*a* are kept out of the slots 20*c* and 102*c*, allowing the process cartridge cover 102 and toner container cover 20 to be opened in the directions indicated by arrow marks N and M, respectively, in FIG. 17(*b*).

(Operation of Mechanism for Opening or Closing Covers during Removal of Process Cartridge)

Next, referring to FIG. 18, the operation of the mechanism when the process cartridge 30 is removed from the image forming apparatus main assembly in order to deal with the recording sheet jam or the like problem will be described.

As the process cartridge cover 102 is opened, the unshown switch for detecting the opening or closing of the process cartridge cover 102 is turned off whereas the switch 43 for detecting the opening or closing of the toner container cover 20 remains in the ON-state. The photosensor 106' remains in the Off-state. Then, as the process cartridge 30 is removed from the apparatus main assembly 1, the projection 33*b* of the toner container 33 is moved away from the projection 104*a* of the toner container detection lever 104. As a result, the toner container detection lever 104 is rotated in the direction of the arrow mark K (FIG. 18(*a*)) by the pressure from the spring, moving the flag 104*e* out of the light path of the photosensor 106. Consequently, the photosensor 106 is turned off.

Figure 18:
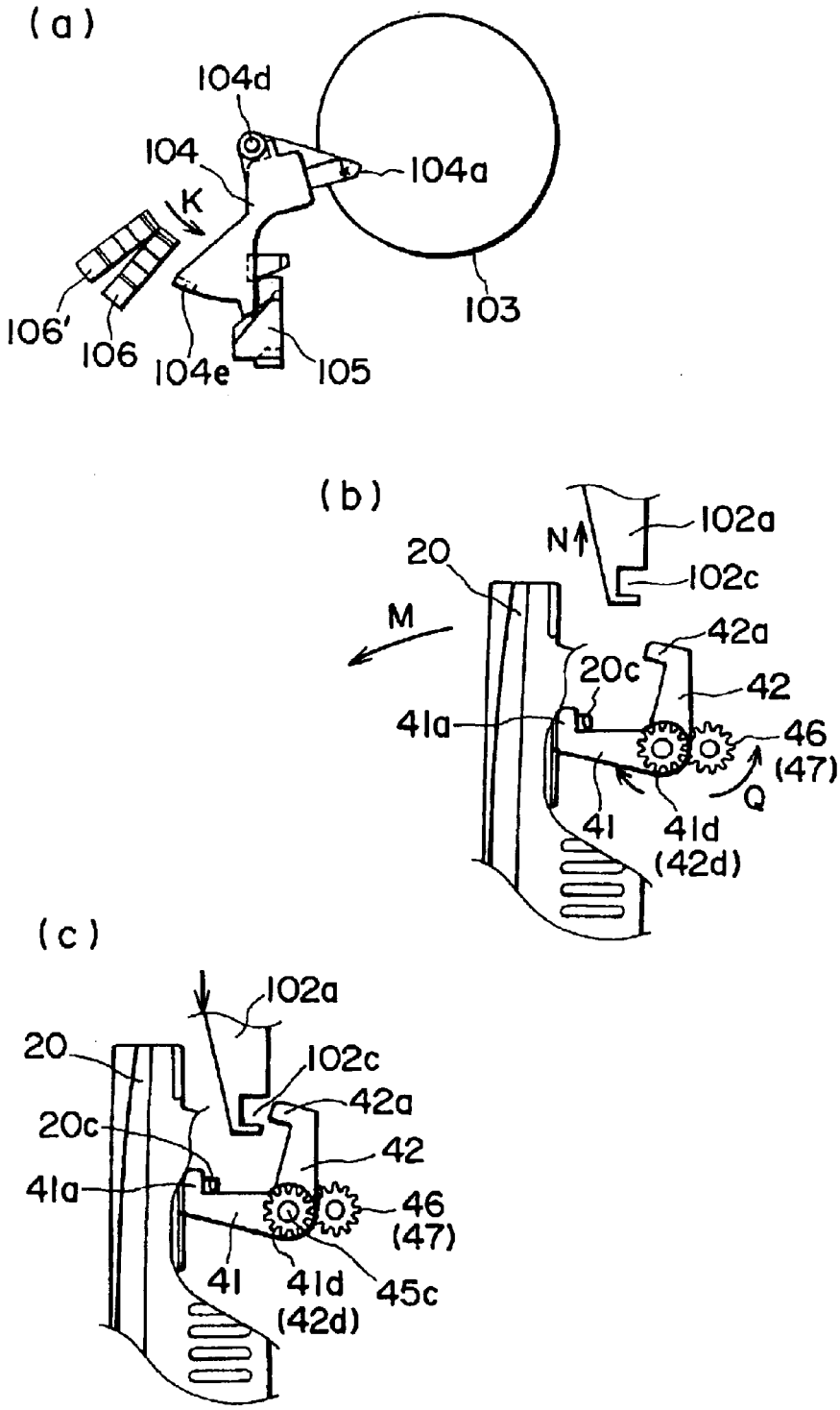
FIGS. 18(*a*), 18(*b*) and 18(*c*) are drawings which show the opening or closing of the cover for the process cartridge and the cover for the toner cartridge, in which 18(*a*) is a front view of the mechanism for opening or closing the covers, and 18(*b*) and 18(*c*) are side views thereof.

Referring to the table in FIG. 21, the hook 42 remains in the open position, and the gear 46 connected to the unshown stepping motor is rotated in the direction indicated by an arrow mark Q in FIG. 18(*b*), to the locking position.

In other words, the hook prop 41*a* of the hook 41 is inserted into the slot 20*c*. Therefore, even if an attempt is made to open the toner container cover 20 in the direction of the arrow mark M, the hook prop 41*a* remains locked in the slot 20*c*, preventing the toner container cover 20 from being opened.

The process of dealing with a recording sheet jam carried out in this embodiment is the same as that in the first embodiment, and therefore, will not be described here.

Next, as the process cartridge cover 102 is closed while the apparatus main assembly 1 is in the above described state, the unshown switch for detecting the opening or closing of the process cartridge cover 102, and the switch 43 for detecting the opening or closing of the toner container cover 20, are turned on, whereas the photosensors and 106 and 106' are turned off. Referring to the table in FIG. 21, the hook 41 remains in the locked position, and hook 42 remains in the open position. Therefore, the toner container cover 20 cannot be opened (FIG. 18(*c*)).

On the other hand, as the process cartridge cover 102 is closed after returning the process cartridge 30 into the apparatus main assembly, the mechanism recovers to the standby state shown in FIGS. 16 and 17.

(Operation of Mechanism for Opening or Closing Covers during Exchanging of Toner Cartridge)

Next, referring to FIGS. 19 and 20, the operation of the mechanism for opening or closing the covers will be described regarding when the toner container 33 is replaced with another toner container (33) to supply the development device with toner.

As the toner container cover 20 is opened, the unshown switch for detecting the opening or closing of the process cartridge cover 102 remains in the ON-position, whereas the switch 43 for detecting the opening or closing the toner container cover 20 and the photosensor 106 are turned off. Further, the photosensor 106' is turned on (FIG. 19(*a*)).

Figure 19:
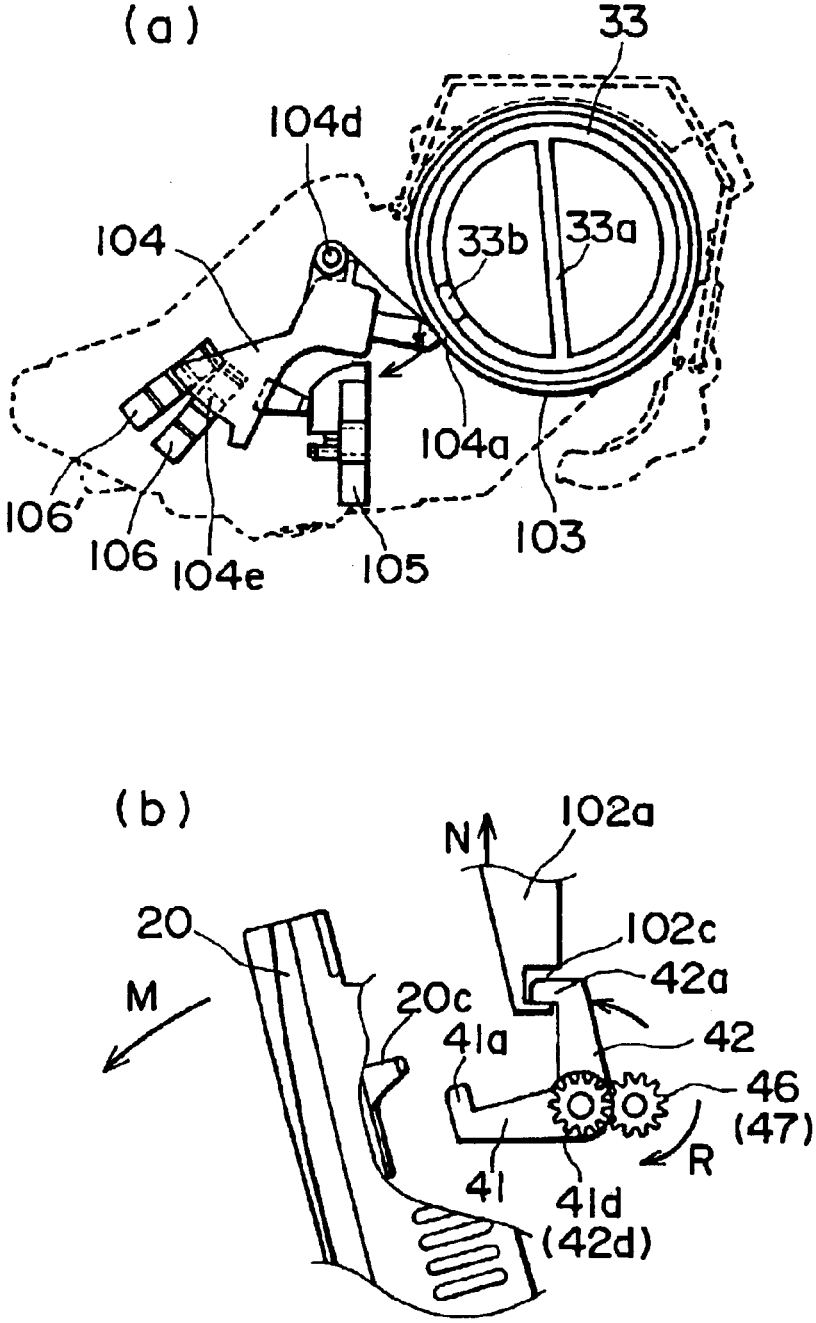
FIGS. 19(*a*) and 19(*b*) are drawings which show the opening or closing of the cover for the process cartridge and the cover for the toner cartridge, in which 19(*a*) is a front view of the mechanism for opening or closing the covers, and 19(*b*) is a side view thereof.

Referring to the table in FIG. 21, the hook 41 remains in the open position, and the gear 47 (disposed on the rear side of the gear 46 in FIG. 19(*b*)) connected to the unshown stepping motor is rotated in the direction indicated by an arrow mark R, rotating thereby only the hook 42 to the locking position.

In other words, the hook prop 42*a* of the hook 42 is inserted into the slot 102*c*. Therefore, even if an attempt is made to open the process cartridge cover 102 in the direction of the arrow mark N, the hook prop 42*a* remains locked in the slot 102*c*, preventing the process cartridge cover 102 from being opened.

The procedure for replacing the toner container 33 is the same as that in the above described first embodiment, and therefore, will not be described here.

Next, if an attempt is made to close the toner container cover 20 while the toner container 33 is not in the development device, the unshown switch for detecting the opening or closing of the process cartridge cover 102 remains in the ON-position, and the switch 43 for detecting the opening or closing of the toner container cover 20 remains in the OFF-state. Further, the photosensors 106 and 106' are turned off (FIG. 20(*a*)).

Figure 20:
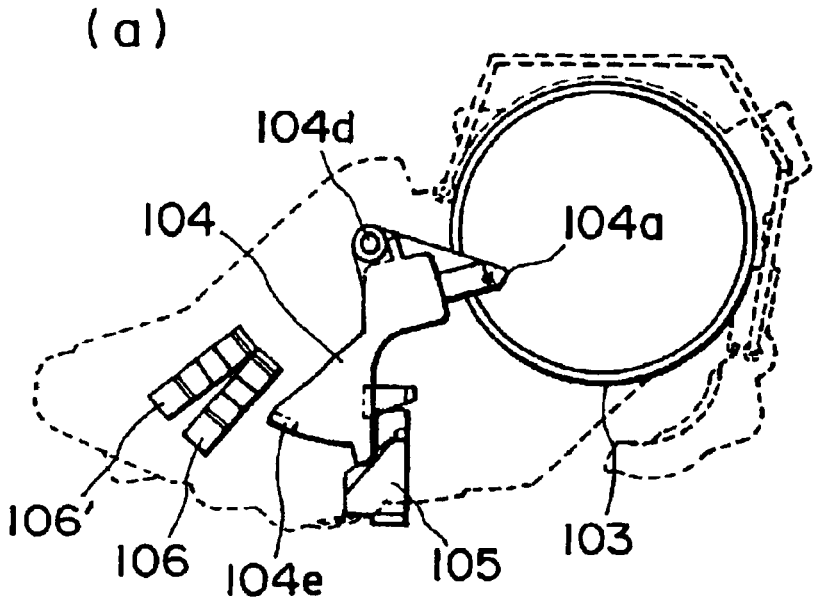
FIGS. 20(*a*) and 20(*b*) are drawings which show the opening or closing of the cover for the process cartridge and the cover for the toner cartridge, in which 20(*a*) is a front view of the mechanism for opening or closing the covers, and 20(*b*) is a side view thereof.
Figure 20:
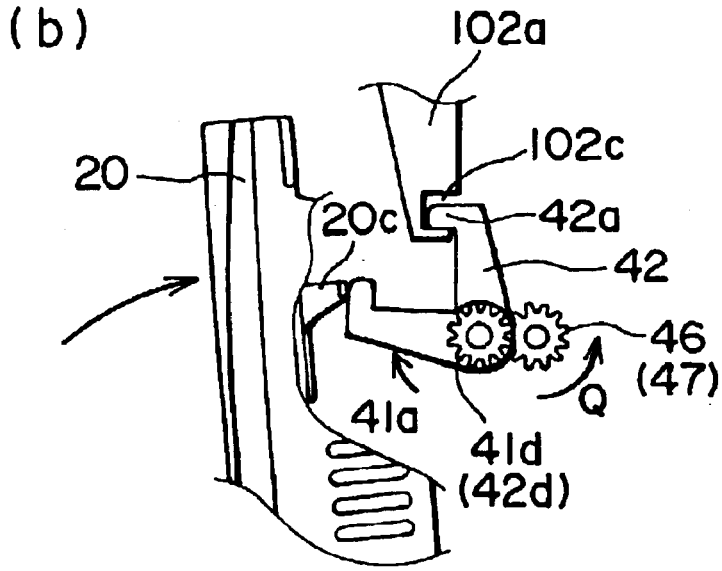
Figure 22:
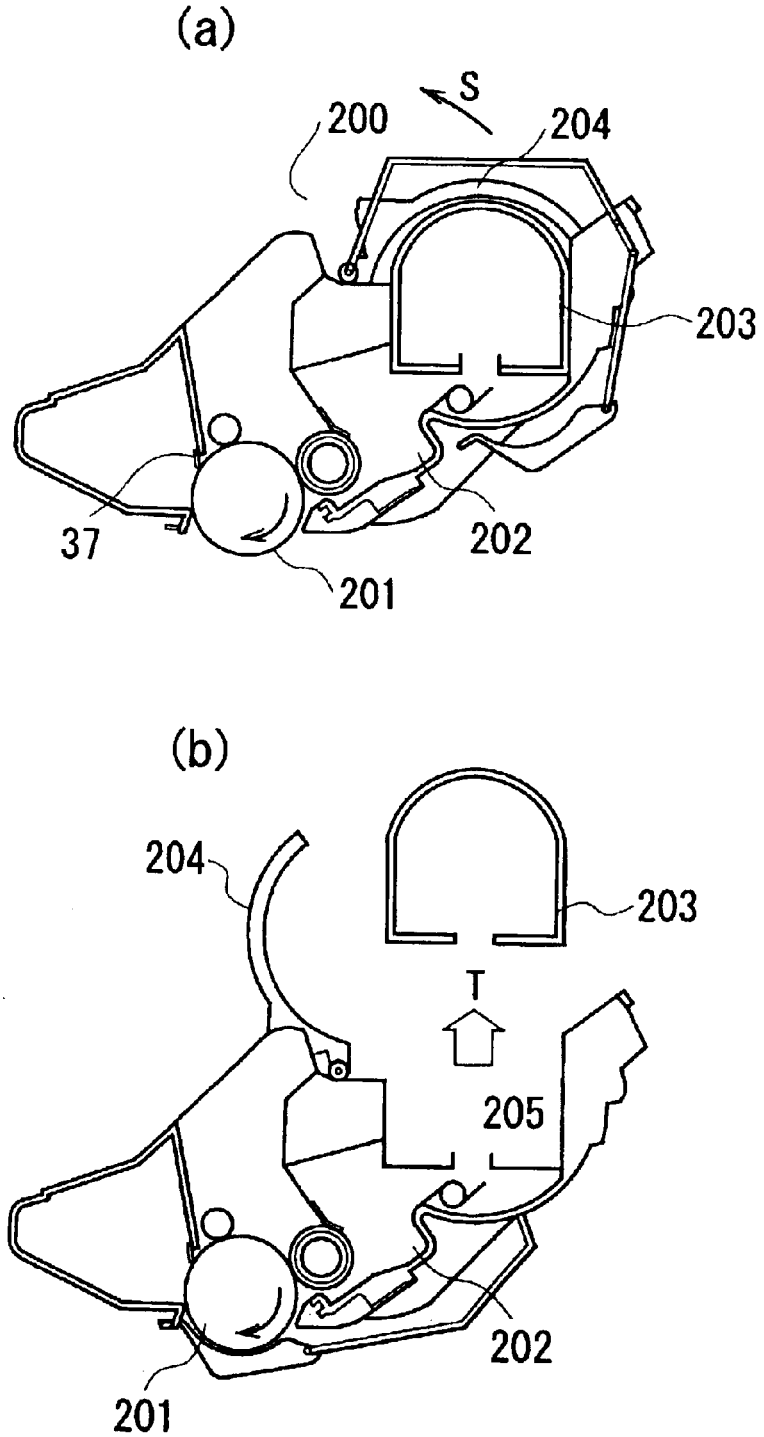
FIG. 22 is a drawing for describing how the toner container in accordance with the prior art is replaced.
Figure 23:
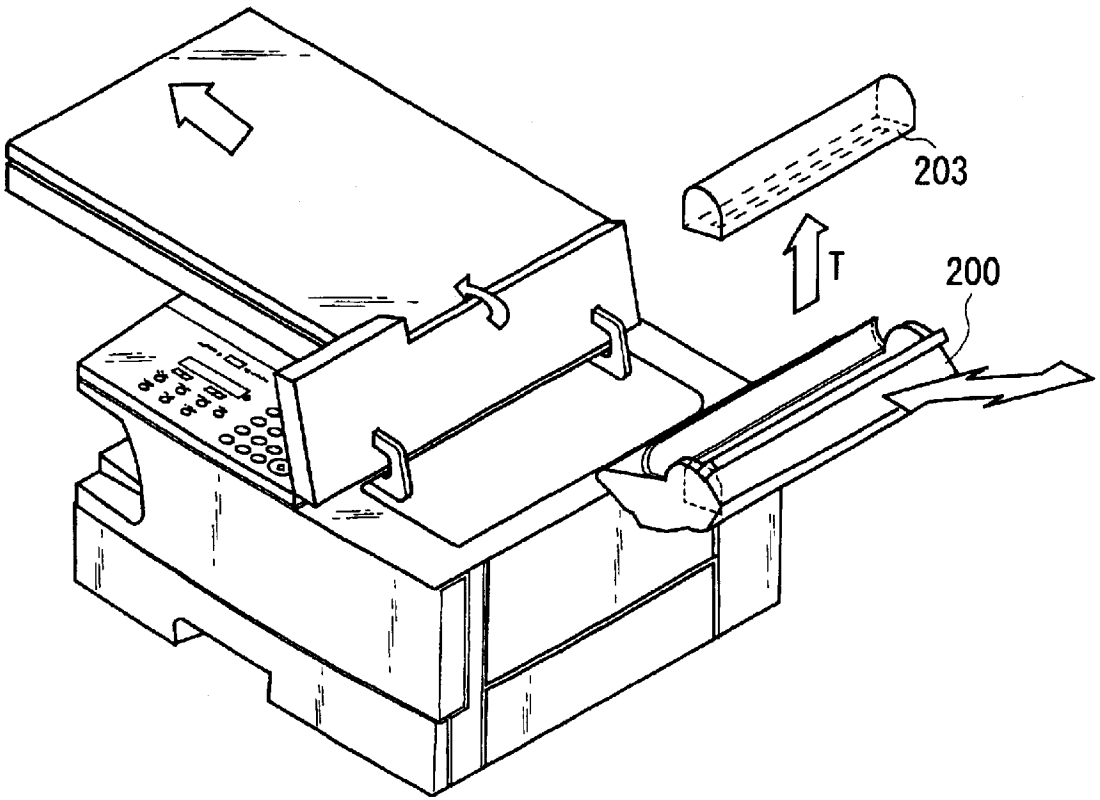
FIG. 23 is a drawing for describing how the toner container in accordance with the prior art is replaced.

Referring to the table in FIG. 21, the hook 42 remains in the locked position, and the gear 46 connected to the unshown stepping motor is rotated in the direction of the arrow mark Q in FIG. 20(*b*), rotating thereby the hook 41 to the point at which the hook 41 becomes locked. During this rotation of the hook 41, the hook 41 is moved to the point at which it becomes locked, before the toner container cover 20 is completely closed. Therefore, it is impossible to completely close the toner container cover 20.

However, if the toner container cover 20 is returned to the position in which the toner container cover 20 allows the toner container 33 to be extracted toward the front side or inserted toward the rear side, the state shown in FIG. 19 is restored.

Thus, as the toner container cover 20 is closed after placing the toner container 33 in the process cartridge 30 by reversely following the steps followed to extract the toner container 33 from the process cartridge 30, the standby state shown in FIGS. 16 and 17 is restored.

As described above, with the provision of the above described structural arrangement, operational effects comparable to those of the first embodiment can be obtained.

To summarize this embodiment, in the image formation unit and image forming apparatus in this embodiment, the direction in which the image formation unit is inserted or extracted is made roughly perpendicular to the rotational axis of the image bearing member. Therefore, it is assured that a sheet jam or the like is easily dealt with. Further, the direction in which the toner supply container is inserted into, or extracted from, the image formation unit is made roughly parallel to the rotational axis of the image bearing member. Therefore, it is possible to replace the toner supply container without removing the image formation unit from the apparatus main assembly, improving thereby operational efficiency. Moreover, the provision of the above-described structural arrangement prevents toner from scattering when mounting or dismounting the image formation unit.

Further, the mechanism for opening or closing the covers is structured so that the image formation unit can be mounted or removed only when the toner supply container is in the image formation unit (only when the toner inlet opening of the image formation unit is actually sealed with the toner supply container). Therefore, toner is less likely to be scattered when mounting or dismounting the image formation unit, compared to the structural arrangement which allows the image formation unit to be mounted or dismounted while the toner supply container is not in the image formation unit. Moreover, it is possible to prevent the problem that toner is scattered by the air allowed to flow through the apparatus main assembly because both covers (doors) are open.

Also with the provision of the above-described structural arrangement, it is unnecessary to provide a mechanism, for example, a shutter mechanism, for opening or closing the toner inlet of the image formation unit. In other words, the above described structural arrangement makes it possible to prevent toner from scattering, while being lower in cost.

Embodiment 3

This embodiment of the present invention is intended to solve the following problems which occur as a toner bottle removably mountable in the process cartridge is provided with a handle for mounting or dismounting the toner bottle.

That is, the lengthwise end surface of the toner bottle, to which the handle is attached, remains exposed, with the handle protruding from the end surface of the toner bottle, even while the toner bottle is mounted into the process cartridge. Therefore, when removing the process cartridge in order to remove a jammed recording sheet or exchange a drum cartridge, the protruding handle is likely to be caught by the edge of the hole 314*c* provided in the internal wall of the image forming apparatus main assembly to allow the toner bottle to be inserted or extracted, or the guide for guiding the process cartridge when the process cartridge is mounted or dismounted.

Figure 34:
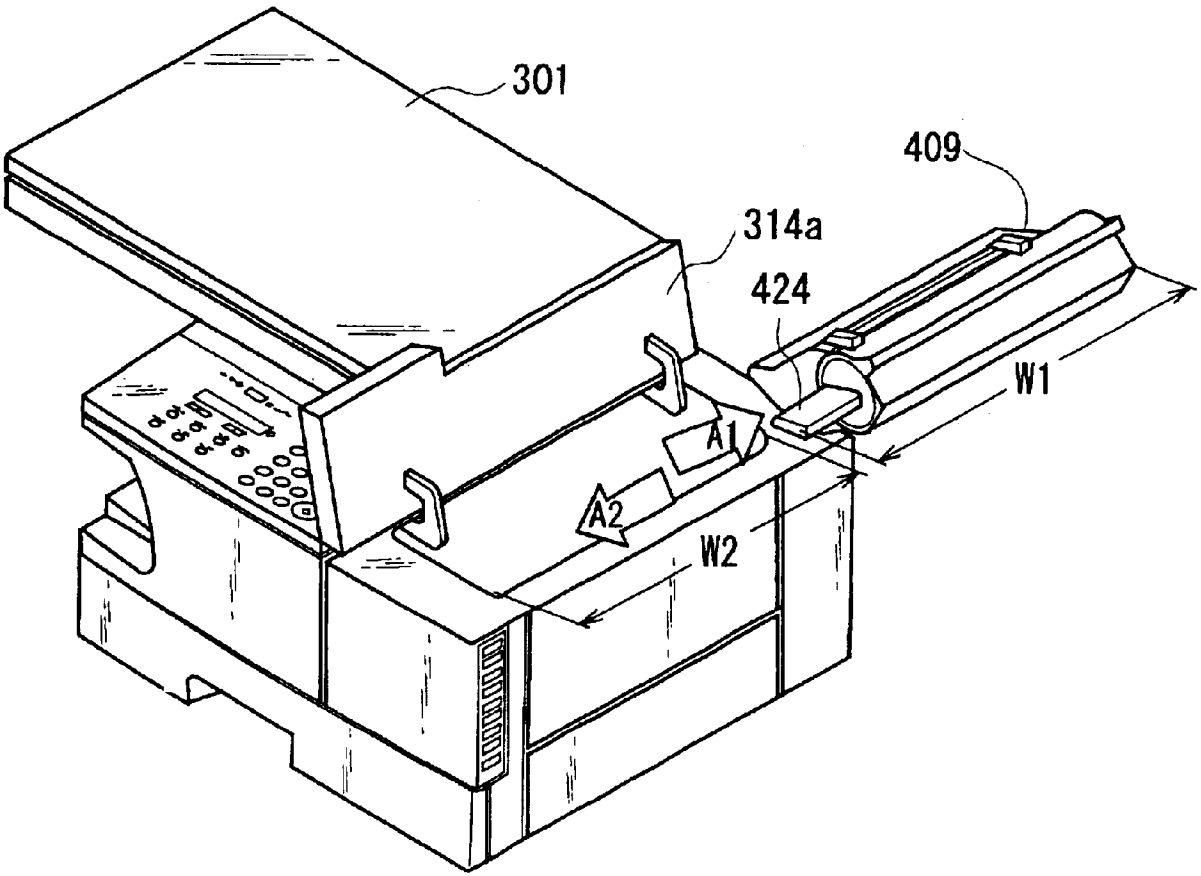
FIG. 34 is a drawing describing the process cartridge in accordance with the prior art, the handle of which does not retract or collapse.

In particular, in the case of a toner bottle, the end surface of which is provided with a large handle 424, that is, a handle easy to grasp, as shown in FIG. 34, in order to make it easier for a user to handle the toner bottle, the handle 424 protrudes from the process cartridge 409 by a substantial distance. Therefore, the need arises for providing the process cartridge with a process cartridge installation space with a length of W2, which is large enough to easily accommodate a process cartridge with a length of W1, inclusive of the handle 424. This provision of the extra space, that is, a wasteful space, for accommodating the protruding handle 424, increases the size of the image forming apparatus main assembly.

Many users, however, want the size of an image forming apparatus, in particular, a small copying machine which is likely to be used with a process cartridge 409, to be smaller. Therefore, the provision of the above-described space for the handle 424 is contrary to the public demand for reducing the image forming apparatus size, being therefore rather difficult.

Figure 35:
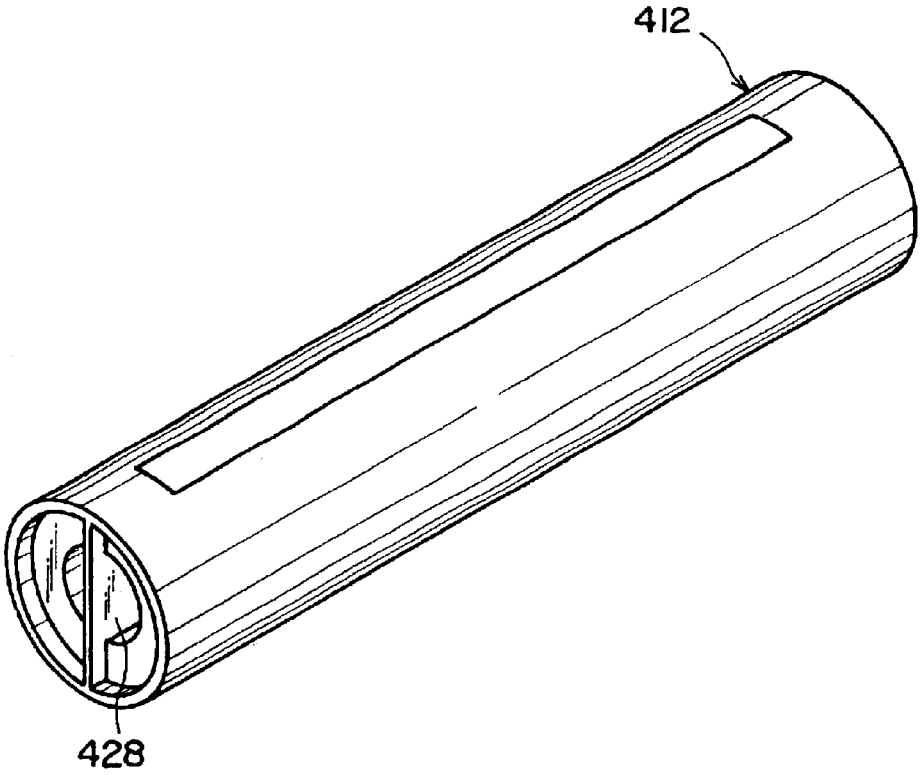
FIG. 35 is a perspective view of the toner bottle in accordance with the prior art, which has a solid handle that does not protrude beyond the external contour of the toner bottle.

Referring to FIG. 35, as for a means for reducing the space for the handle 428, it is possible to provide the end portion of the toner bottle 412 with a recess, and place the handle 428 in this recess. This method, however, has the following problem. That is, the diameter of this toner bottle is roughly 5 cm. Therefore, the placement of the handle in the recess provided in the end portion of the toner bottle 412 does not afford a sufficient amount of space around the handle 428. Further, the toner bottle 412 is to be rotated after the complete insertion of the toner bottle 412 into the process cartridge in the image forming apparatus main assembly. Thus, in order to rotate the toner bottle 412, the handle 428 must be grasped through the opening of the hole for inserting or extracting the toner bottle 412. Without the presence of a substantial amount of space around the handle 428, it is difficult for a user to open his hand wide enough to firmly grip the handle. In other words, the structural arrangement shown in FIG. 35 makes it difficult for the user to firmly grip the handle 428; it makes the toner container 412 very difficult to operate.

This problem can be solved by structuring the combination of the toner supply container, process cartridge, and image forming apparatus in the manner which will be described later. Next, the details of this embodiment will be described.

The basic structures of the toner supply container, process cartridge, and image forming apparatus in this embodiment are the same as those in the preceding embodiment. However, they will be described again with reference to drawings different from those referred to in the description of the preceding embodiments.

Figure 24:
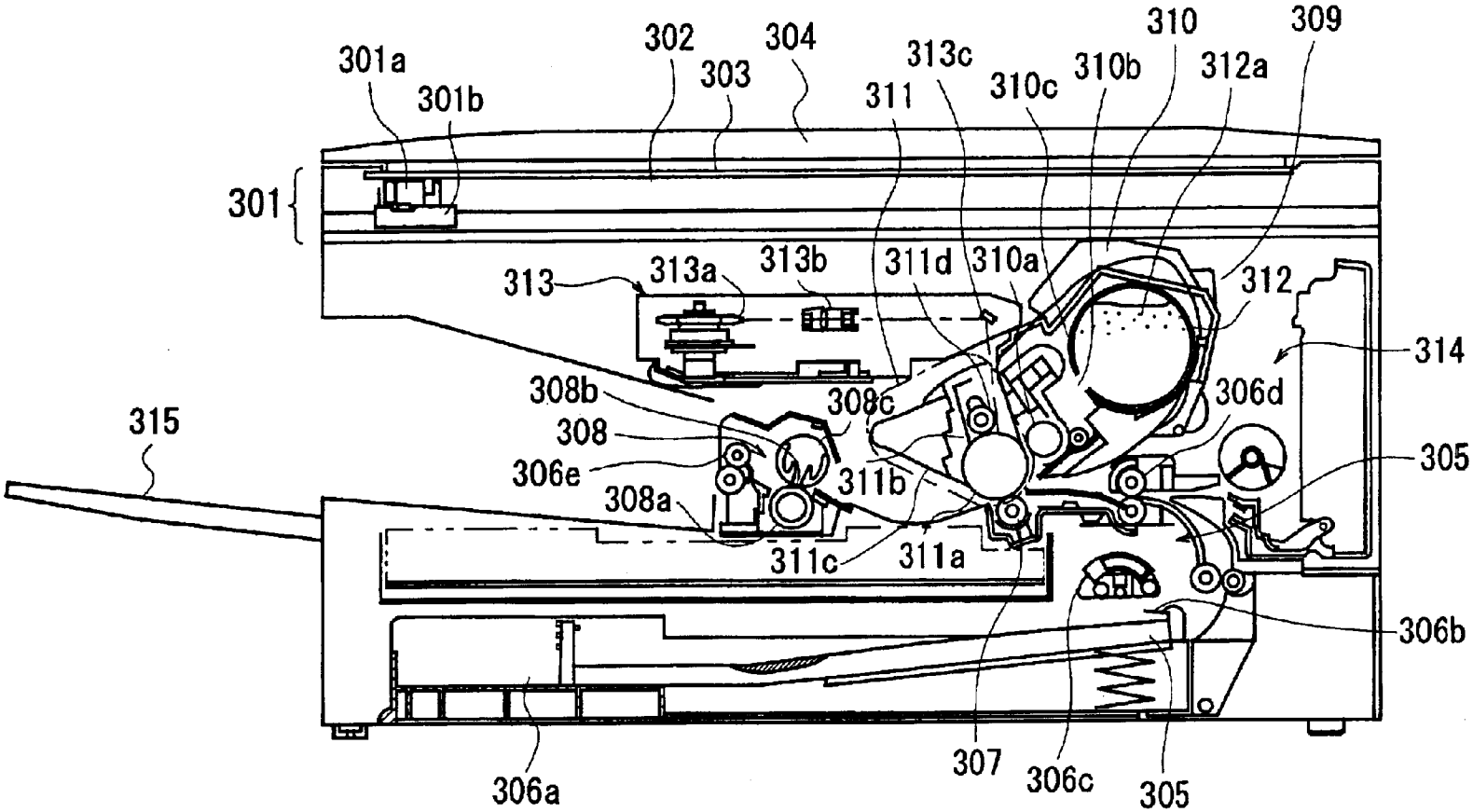
FIG. 24 is a sectional view of the image forming apparatus in the third embodiment of the present invention.
Figure 25:
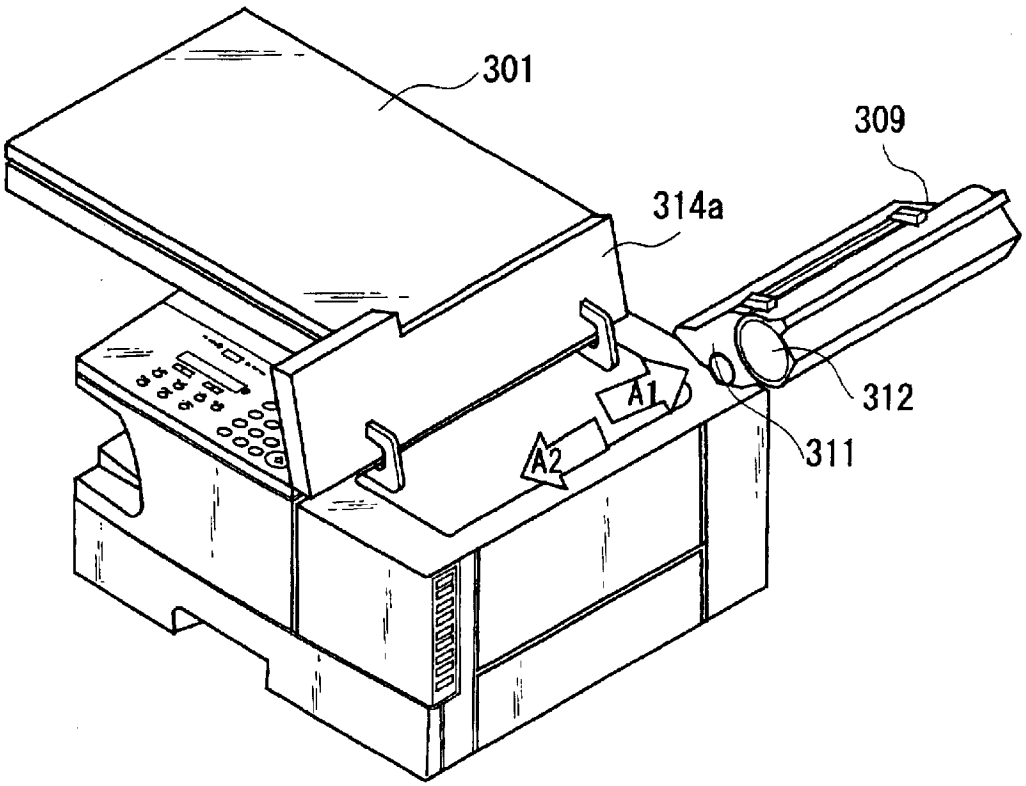
FIG. 25 is a drawing showing how the process cartridge is inserted into the image forming apparatus.
Figure 26:
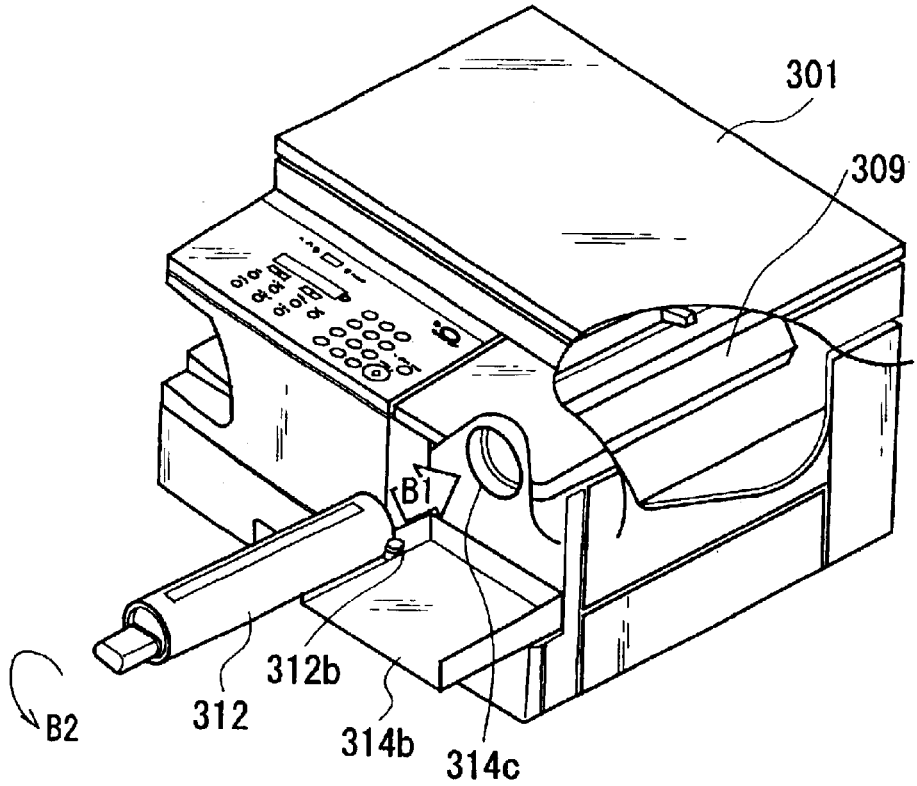
FIG. 26 is a drawing showing how the toner bottle is inserted into the image forming apparatus.
Figure 27:
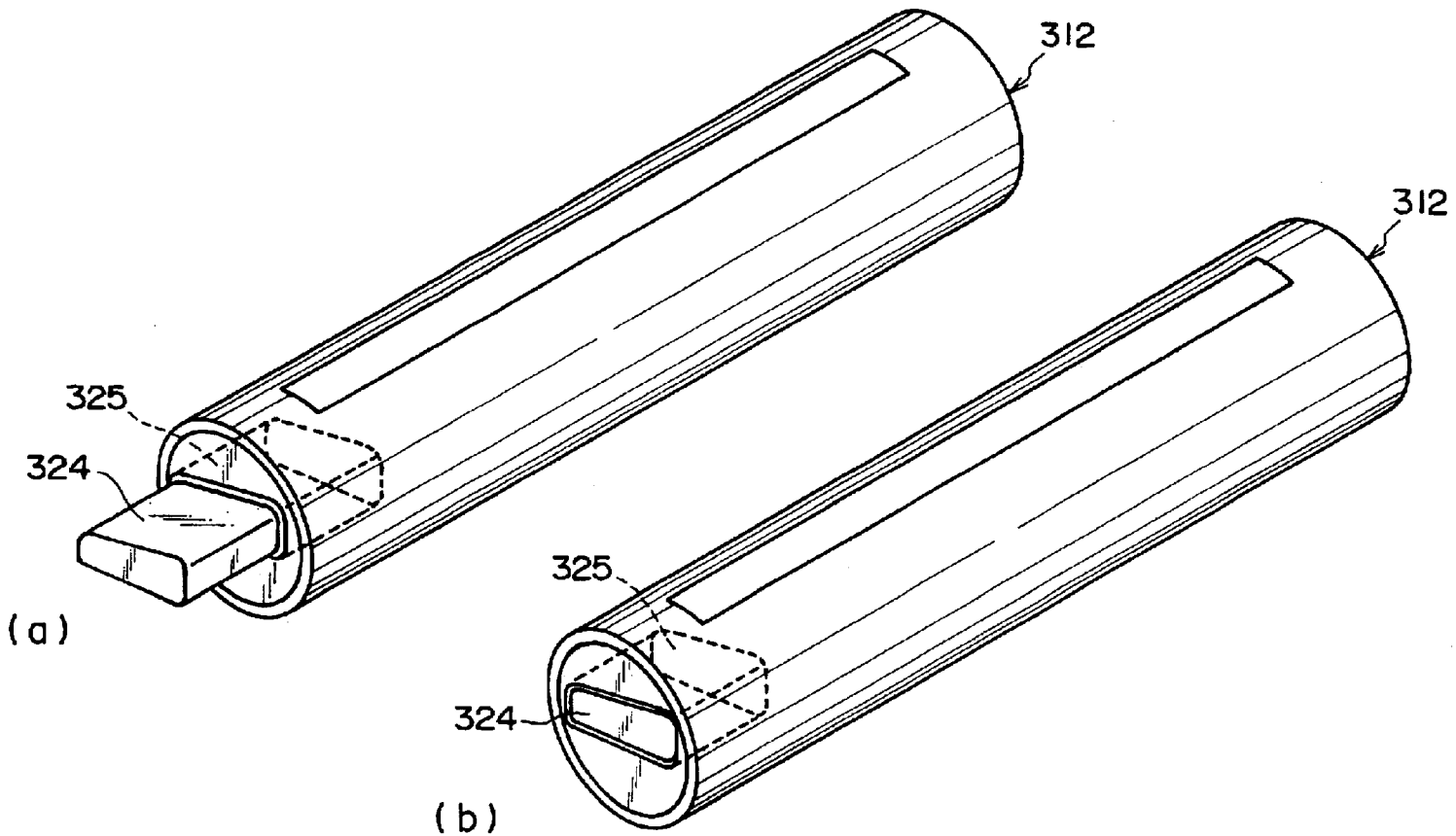
FIGS. 27(*a*) and 27(*b*) are perspective views of the toner bottle with a retractable handle.

FIG. 24 is a sectional view of the image forming apparatus in this embodiment, and FIG. 25 is a drawing for describing how the process cartridge is inserted into the image forming apparatus. FIG. 26 is a drawing for describing how the toner bottle is inserted into the image forming apparatus, and FIG. 27 is a perspective view of the toner bottle with a retractable handle. The process cartridge has an image forming means for forming images.

In consideration of usability, the process cartridge in this embodiment comprises an image bearing member and a minimum of one processing means for forming an image on the image bearing member, which are integrally disposed in the process cartridge. The image bearing member will be described later. The processing means includes a charging means, a developing means, and a cleaning means.

Referring to FIG. 24, an original reading apparatus 301 disposed on the image forming apparatus reads an original placed on the original placement platen, and sends to a laser scanner unit 313 the signals it obtains by reading the original. The laser scanner unit 313 emits a beam of laser light in accordance with the signals sent from the original reading apparatus 301. The beam of laser light is deflected by a polygon mirror 313*a*, toward a focusing lens 313*b*, and is focused by the focusing lens 313*b* on the photoconductive drum 311*a* in the process cartridge 309, exposing thereby the photoconductive drum 311*a*.

Meanwhile, the photoconductive drum 311*a* is uniformly charged by a primary charge roller 311*d* as a charging means. Thus, as the photoconductive drum 311*a* is exposed to the above described beam of light, a latent image is formed on the photoconductive drum 311*a*. In the other part of the image forming apparatus, toner is supplied to the development chamber 310*b* as a developing means, from the toner bottle, which has been mounted in the process cartridge 309. In the development chamber 310*b*, the toner is coated across the entirety of the peripheral surface of the development sleeve 310*a*, as a developing means, which contains a magnet. The toner on the peripheral surface of the development sleeve 310*a* transfers onto the electrophotographic photoconductive drum 311*a*, as an image bearing member, in the pattern reflecting the latent image on the photoconductive drum 311*a*. As a result, a visible image is formed on the photoconductive drum 311*a*.

The image forming apparatus is provided with a sheet feeding cassette 306 and a sheet conveyance tray 305 capable of feeding sheets of different sizes, from which a single or plurality of sheets 305 are fed into the image forming apparatus main assembly. After being fed into the apparatus main assembly, each sheet 305 is sent to the nip, that is, the contact area, between the photoconductive drum 311*a* and a transfer roller 307. While the sheet 305 is conveyed past the nip, transfer bias is applied to the transfer roller 307 from an unshown transfer bias power source. As a result, the image formed on the photoconductive drum 311*a* is transferred onto the sheet 305.

The toner, which remained on the photoconductive drum 311*a* without being transferred onto the sheet 305, is scraped down by a cleaning blade 311*b* as a cleaning means, and is recovered into the waste toner bin 311*c*. The sheet 305 onto which the image was transferred is sent to a fixing apparatus 308. In the fixing apparatus 308, the sheet 305 is passed between the fixing film 308*c* heated by a heater 308*b*, and a pressure roller 308*a*. As a result, the image is fixed to the sheet 305. Thereafter, the sheet 305 is discharged into the delivery tray 315 by a pair of discharge rollers 306*e*, which concludes the formation of an image on the sheet 305 through the above described steps.

The image forming portion (comprising: development sleeve 310*a*, photoconductive drum 311*a*, cleaning blade 311*b*, etc.), as an image forming means, in the image forming apparatus, is shorter in service life compared to the other portions in the image forming apparatus main assembly. Thus, the components of the image forming portion are integrated in the form of the process cartridge 309 so that they can be easily replaced by a user.

The process cartridge 309 can be separable into a development unit 310 comprising a toner bottle 312, the development sleeve 310*a*, etc., and a drum cartridge 311 comprising the waste toner bin 311*c* for storing the waste toner recovered by the cleaning blade 311*b*, the photoconductive drum 311*a*, etc. Therefore, it is possible to replace only the drum cartridge 311, which is shorter in service life than the apparatus main assembly or development unit 310, with a new drum cartridge (311), making it possible to inexpensively maintain a high level of image quality.

Further, in order to make it possible for a user to simply and inexpensively add toner to the process cartridge 309, the process cartridge 309 is structured so that the toner bottle 312 filled with toner can be inserted into the process cartridge 309. More specifically, as the amount of the toner in the process cartridge 309 reduces to a critical level, the process cartridge 309 can be supplied with toner by removing the old toner bottle (toner bottle in process cartridge) 312 from the process cartridge 309 and inserting a new toner bottle (312) into the process cartridge 309. The above described structural arrangement, which makes it possible to replace only the components necessary to be replaced among the components of the process cartridge 309, makes it possible to inexpensively maintain image quality at a high level. Further, it reduces the number of components to be replaced to maintain image quality at a high level, being therefore beneficial in terms of environmental protection.

Next, referring to FIG. 25, the procedure for replacing the drum cartridge 311 will be described. As the service life of the drum cartridge 311 expires, for example, the photoconductive drum 311*a* wears out and/or the waste toner bin becomes full of waste toner, the drum cartridge 311 is to be replaced.

First, a CRR cover 314*a* is to be exposed by sliding sideways the image reading apparatus 301 on the apparatus main assembly. Then, after opening the CRR cover 314*a*, the process cartridge 309 containing the toner bottle is to be extracted from the image forming apparatus main assembly, in the diagonally upward direction, that is, the direction indicated by an arrow mark A1. Then, the drum cartridge 311 is to be separated from the process cartridge 309, and a new drum cartridge (311) is to be attached to the process cartridge 309, which concludes the replacement of the drum cartridge 311. Incidentally, the process cartridge 309 is removed in order to remove the jammed sheet from the sheet conveyance path when a sheet jam occurred in the adjacencies of the process cartridge 309. After the completion of the above described operations, the process cartridge 309 is to be inserted in the direction indicated by an arrow mark A2 in order to ready the image forming apparatus for recording.

Next, referring to FIGS. 26 and 27, the procedure for replacing the toner bottle 312 (supplying process cartridge 309 with toner) will be described. As the toner within the process cartridge 309 reduces due to the continuation of recording, toner is to be added to the process cartridge 309 by replacing the toner bottle 312 while the process cartridge 309 is in the image forming apparatus.

Referring to FIG. 27, the toner bottle 312 is provided with a handle 324 and a handle retraction hole 325, which are located at one of the lengthwise ends of the toner bottle 312, more specifically, the lengthwise end corresponding, in position, to the toner bottle insertion-extraction opening 314*c* of the apparatus main assembly. The handle 324 is structured so that it can be slid in the lengthwise direction of the toner bottle; the handle 324 is fully retractable into the handle retraction hole 325 so that the handle 324 does not protrude beyond the external contour of the toner bottle as well as the external contour of the process cartridge 309. The toner bottle 312 is desired to be structured to allow the handle 324 to be retractable into the handle retraction hole 325 so that at least the handle 324 does not protrude beyond the external contour of the process cartridge 309.

The structure of the image forming apparatus main assembly is such that a user is required to mount the toner bottle 312 into the process cartridge 309 in the rear side of the image forming apparatus. However, with the provision of the above described handle 324, a user will not be inconvenienced when mounting the toner bottle.

More specifically, referring to FIG. 27(*a*), when handling the toner bottle, the handle 324 can be pulled out to make it easy to grasp the handle 324, so that the toner bottle can be easily inserted in the horizontal direction indicated by the arrow mark B1 and be rotated in the circumferential direction indicated by an arrow mark B2. Further, referring to FIG. 27(*b*), after the handling of the toner bottle, the handle 324 can be pushed into the toner bottle 312 in order to place the handle 324 in the range within the external contour of the process cartridge 309.

The handle 324 and the wall of the handle retraction hole 325 may be provided with unshown a recess (projection) and a projection (recess), respectively, so that as the handle 324 is pushed into the toner bottle, the combination of the recess and projection provides a user with a feel of clicking. The provision of this combination of the recess and projection also can prevent the handle 324 from accidentally slipping out of the handle retraction hole 325.

Next, referring to FIG. 26, as the toner runs out, the toner bottle 312 is to be replaced in the following manner. First, the front door 314*b* of the image forming apparatus main assembly is to be opened to remove the toner bottle 312. Then, a user is to pull out the handle 324 from the handle retraction hole 325 by inserting a hand through the toner bottle insertion-extraction opening 314*c* of the internal wall of the apparatus main assembly. Then, the user is to pull out only the toner bottle 312 from the process cartridge 302 in the image forming apparatus main assembly by grasping the handle 324.

During the above described process of removing the toner bottle 312, there is a possibility that the toner having accumulated in the development chamber 310*b* of the process cartridge 309 will overflow into the space vacated by the toner bottle 312. Thus, the process cartridge 309 is provided with a rotary bottle shutter 310*c* for preventing this overflowing of the toner. The bottle shutter 310*c* is structured so that it engages with the projection 312*b* of the toner bottle 312 and can be opened or closed by rotating the toner bottle 312 in the circumferential direction B2. Thus, when removing the toner bottle 312, first, the user is to rotate the toner bottle 312 in the circumferential direction B2 by grasping the handle 324. This will cause the bottle shutter 310*c* to seal the development chamber 310*b*, preventing the toner from overflowing therefrom. Then, the toner bottle 312 can be extracted from the process cartridge 309 by pulling the handle 324 in the horizontal direction B1.

After the removal of the toner bottle 312 from the process cartridge 309, a new toner bottle (312), that is, a sealed toner bottle filled with a large amount of toner, is to be mounted in the process cartridge 309 in the following manner. First, the user is to insert the new toner bottle 312 into the process cartridge 309 in the horizontal direction B1 by grasping the handle 324. Then, the toner bottle 312 is to be rotated in the circumferential direction B2. As the toner bottle 312 is rotated, the bottle shutter 310*c* is opened, allowing the toner in the toner bottle 312 to flow into the development chamber 310*b* (allowing the development chamber 310*b* to be supplied with the toner). Lastly, the handle 324 is to be slid into the handle retraction hole 325, and the front door 314*b* is to be closed to complete the toner supplying process.

As described above, the provision of the above described structural arrangement, which allows the handle 324 to be retracted so that the handle 324 does not protrude beyond the external contour of the process cartridge 309, eliminates the need for providing the apparatus main assembly with the space for the handle 324, making it possible to reduce the size of the apparatus main assembly.

Also with the provision of the above described structural arrangement, the handle 324 is not caught by the edge of the toner bottle insertion-extraction hole 314*c* of the internal wall of the apparatus main assembly when inserting or extracting the process cartridge 309. Therefore, the process cartridge 309 can be smoothly inserted into, or extracted from, the apparatus main assembly.

Embodiment 4

Figure 28:
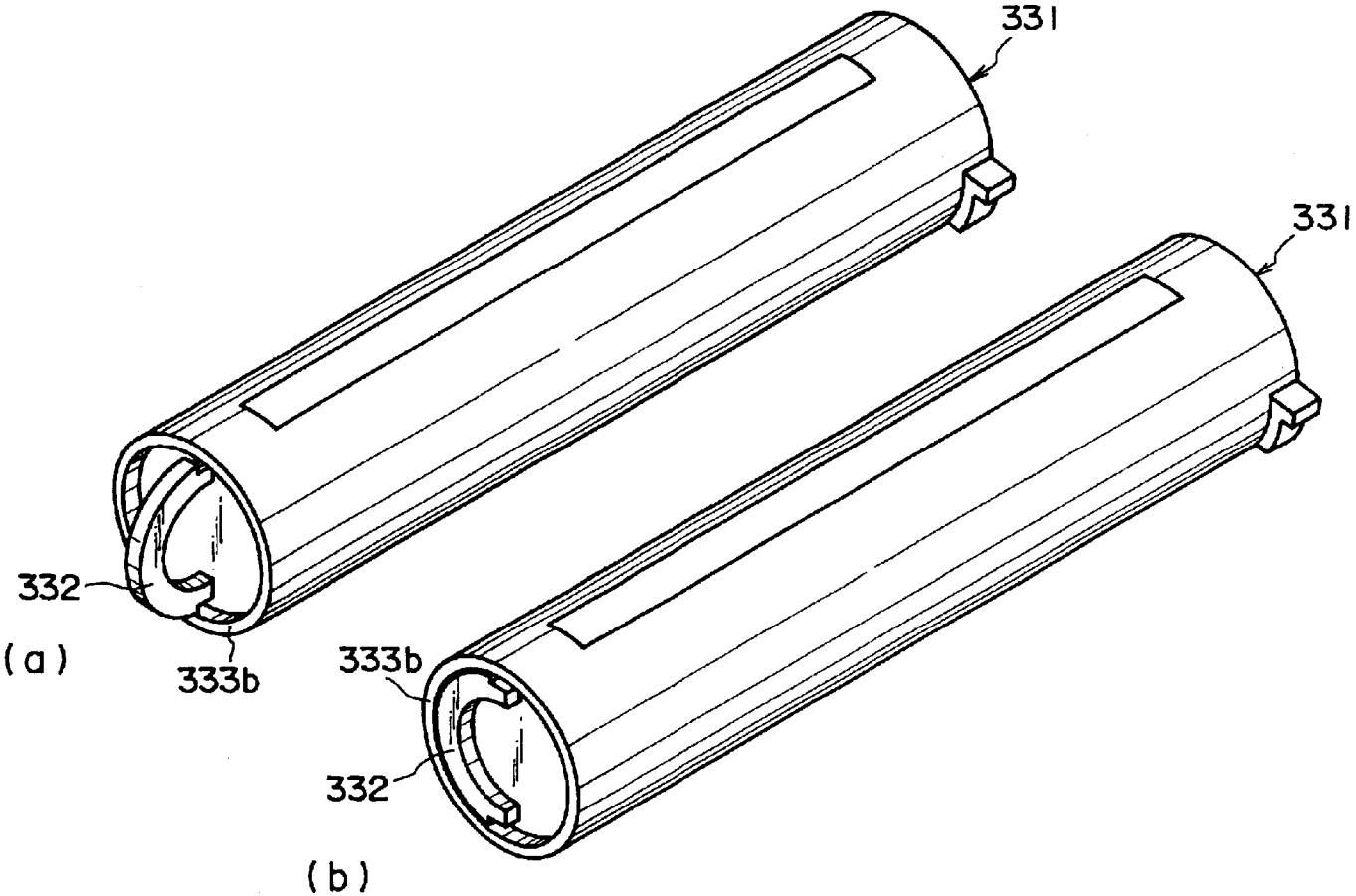
FIGS. 28(*a*) and 28(*b*) are perspective views of the toner bottle with a collapsible handle, in the fourth embodiment of the present invention.
Figure 29:
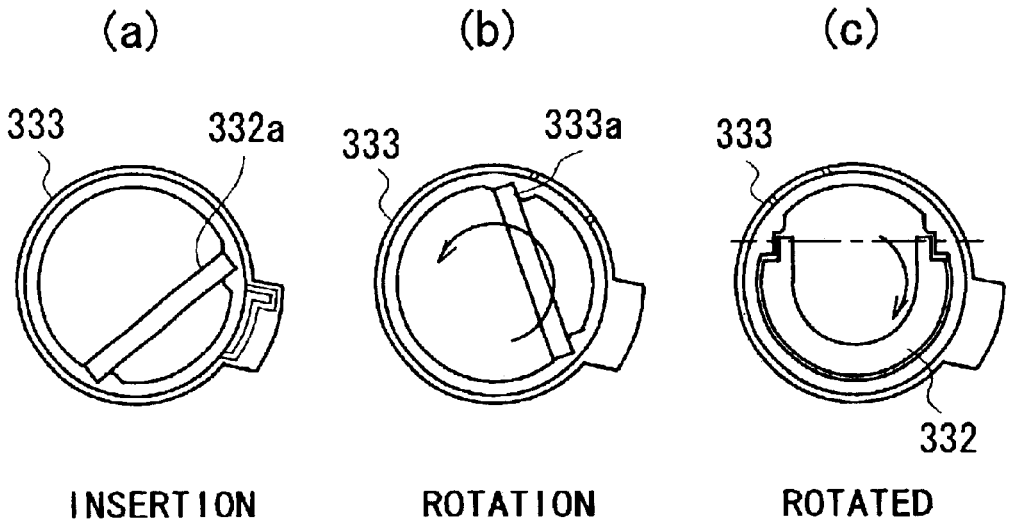
FIGS. 29(*a*), 29(*b*) and 29(*c*) are drawings describing the movement of the handle during the insertion of the toner bottle into the image forming apparatus.
Figure 30:
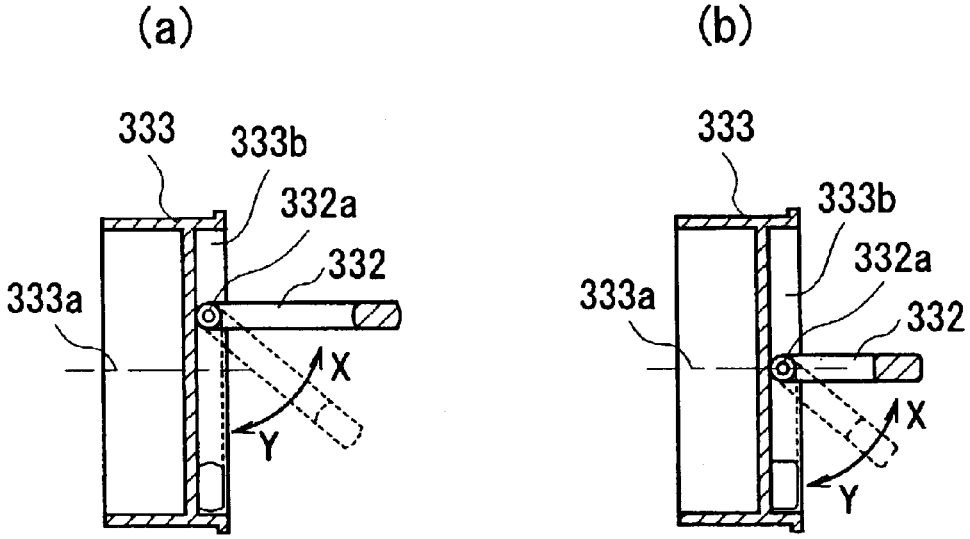
FIGS. 30(*a*) and 30(*b*) are drawings describing the collapsible handle.
Figure 31:
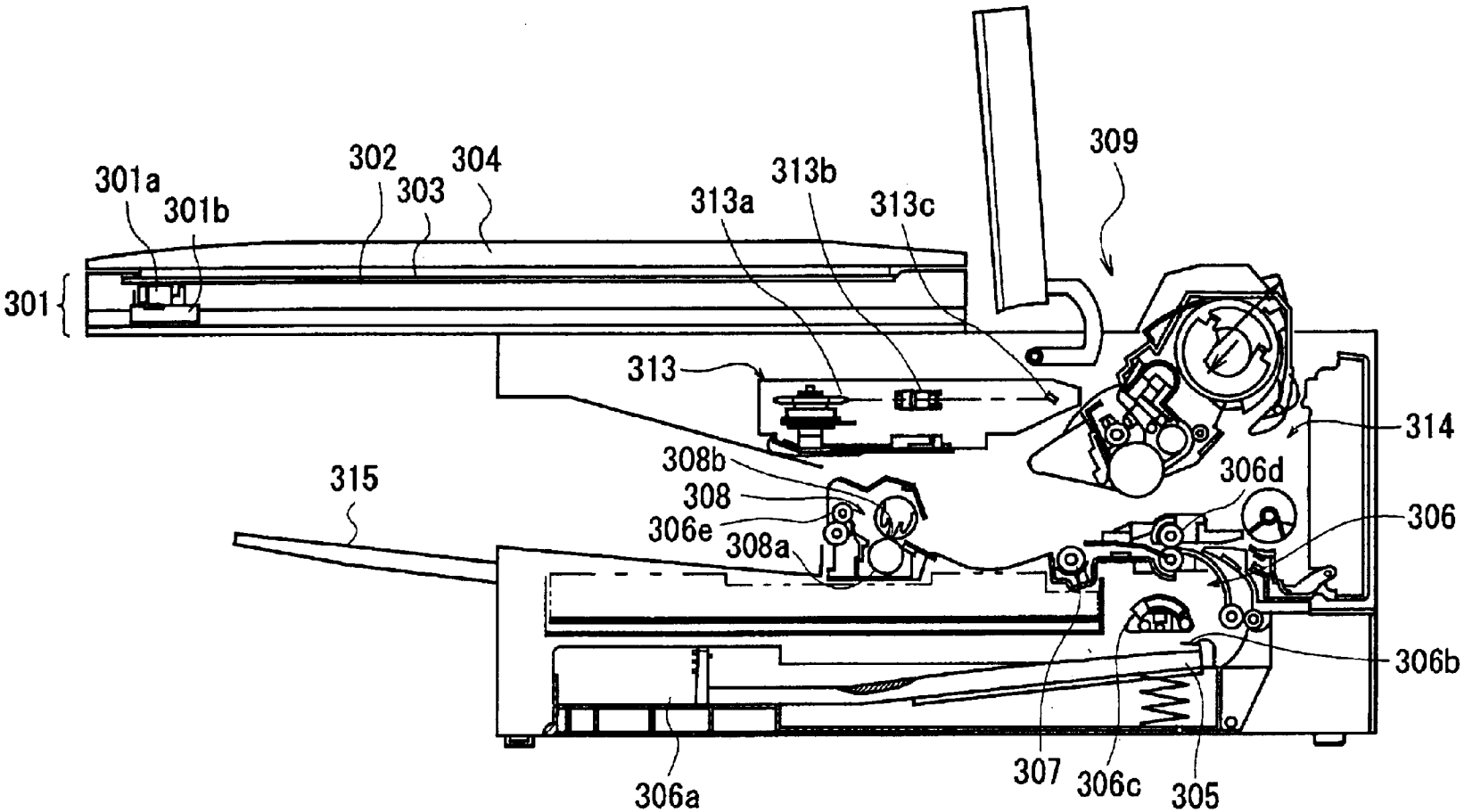
FIG. 31 is a drawing describing that the direction in which the process cartridge is removed from the image forming apparatus is roughly parallel to the direction into which the handle is rotationally collapsed.
Figure 32:
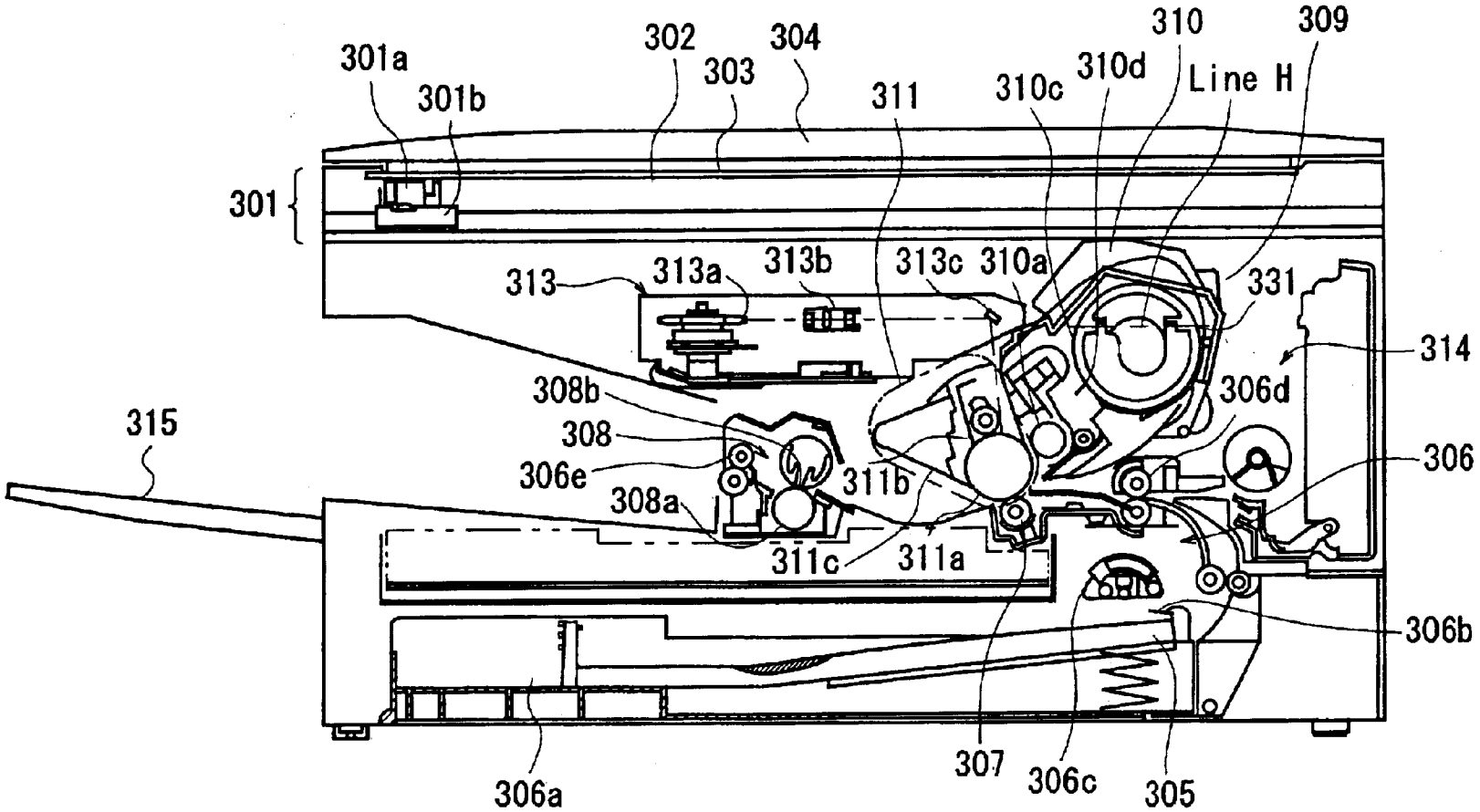
FIG. 32 is a drawing describing the structure which makes the rotational axis of the handle of the toner bottle horizontal as the toner bottle is mounted into the process cartridge in the image forming apparatus.

Next, the toner supply container, process cartridge, and image forming apparatus in the fourth embodiment of the present invention will be described with reference to the appended drawings. FIG. 28 is a perspective view of the toner bottle in this embodiment, which is provided with a collapsible handle, and FIG. 29 is a drawing for showing the movement of the handle which occurs as the toner bottle is inserted into the image forming apparatus. FIG. 30 is a drawing for describing the collapsible handle, and FIG. 31 is a drawing for describing that the direction in which the process cartridge is removed from the image forming apparatus is roughly parallel to the direction into which the handle is collapsed. FIG. 32 is a drawing for describing the structural arrangement that makes the rotational axis of the collapsible handle horizontal as the toner bottle is mounted into the process cartridge. The portions of the toner container, process cartridge, and image forming apparatus in this embodiment, which are the same as those in the above described third embodiment, will be given the same referential symbols as those given in the third embodiment, and will not be described here to avoid the repetition of the same descriptions.

Referring to FIG. 28, the toner supply container, process cartridge, and image forming apparatus in this embodiment are substantially the same as those in the above described third embodiment, except that in this embodiment, a toner bottle 331 with a collapsible handle 332 is employed as the toner supply container, instead of the toner bottle 312 with the retractable handle 324 in the third embodiment. The collapsible handle 332 of the toner bottle 331 is attached to the lengthwise end of the toner bottle, the position of which corresponds to the position of the toner bottle insertion-extraction opening 314*c*.

Referring to FIG. 30, the handle 332 is rotatable about the rotational axis 332*a* so that it can be retracted into the range within the external contour of the process cartridge 309. When handling the toner bottle, the collapsible handle 332 is to be raised in the direction indicated by an arrow mark X so that the grip portion of the handle becomes perpendicular to the end surface of the toner bottle. This makes it easier for the handle 332 to be grasped, making it therefore easier for a user to handle the toner bottle. Incidentally, the handle 332 may be given a U-shape so that the toner bottle can be easily pulled by hooking the handle 332 by a finger. Since the handle 332 in this embodiment is structured so that it can be laid flat virtually in parallel to the end surface 333*b* of the toner bottle cap 333, the space which the toner bottle is required to accommodate the handle 332 is smaller than that in the third embodiment; the toner storage space of the toner bottle in this embodiment is greater than the in the third embodiment, by the amount roughly equivalent to the size of the toner retraction hole 325 in the third embodiment. Therefore, the toner bottle in this embodiment is greater in the number of copies which can be produced per toner bottle, reducing thereby image formation cost. Further, the overall length of the toner bottle can be substantially reduced by collapsing (laying down) the handle 332, making it possible to reduce the sizes of the image forming apparatus and cartridges as much as possible.

Next, referring to FIG. 29, when mounting the toner bottle 331, first, the user is to insert the toner bottle 331 into the process cartridge 309 by grasping the handle 332 while keeping it in the upright position (FIG. 29(*a*)), and the toner bottle 331 is to be rotated in order to open the bottle shutter 310*c* (FIG. 29(*b*)). This concludes the process of mounting the toner bottle 331 (FIG. 29(*c*)).

Further, referring to FIG. 30(*a*), after the mounting of the toner bottle 331, the rotational axis of the handle 332*a* is roughly horizontal (line H in FIG. 32). Thus, as the user finishes handling the toner bottle 331, the handle 332 automatically rotates in the direction of an arrow mark Y due to its own weight; in other words, it automatically retracts into the recess at the lengthwise end of the toner bottle 331.

Further, also when removing the process cartridge 309, the attitude of the process cartridge 309 is maintained so that the rotational axis 332*a* of the handle 332 remains roughly horizontal (line H in FIG. 32). Thus, the handle 332 of the toner bottle 331 remains laid flat in the recess of the lengthwise end of the toner bottle 331 due to its own weight, and therefore, it does not interfere with the process of mounting or dismounting the process cartridge 309.

Incidentally, the rotational axis 332*a* of the handle 332 may be attached to the end surface of the toner bottle 331, slightly off the axial line of the toner bottle 331. More specifically, the grip portion of the handle is made arcuate so that it matches the cylindrical shape of the toner bottle, and this arcuate grip portion may be made longer than half the circumference of the end surface of the toner bottle.

This structural arrangement makes the grip portion of the handle longer and larger, being therefore easier to grasp, and yet, makes it possible to retract the handle into the range within the external contour of the toner bottle 331, not only reducing thereby the overall length of the toner bottle 331, but also preventing the handle 332 from interfering with the process of mounting or dismounting the process cartridge 309. Moreover, not only does the placement of the rotational axis of the handle 332 offset from the rotational axis of the toner bottle 331 make it possible to increase the length of the grip portion of the handle 332, making it thereby easier to handle the toner bottle 331, but also increases the weight of the handle, helping thereby the handle 332 automatically collapses (rotates downward) due to its own weight.

Further, referring to FIG. 31, the direction into which the handle 332 of the toner bottle 331 rotates (collapses) after the mounting of the toner bottle 331 may be made roughly parallel to the direction in which the process cartridge 309 is removed. With the provision of this structural arrangement, should a user forget to lay down the handle 332, the handle 332 lays down (retracts) as it comes into contact with the edge of the toner bottle insertion-extraction opening 314*c* when the process cartridge 309 is removed. Therefore, the handle 332 is not caught by the edge of the toner bottle insertion-extraction opening 314*c*; it does not interfere with the removal of the process cartridge 309.

Embodiment 5

Figure 33:
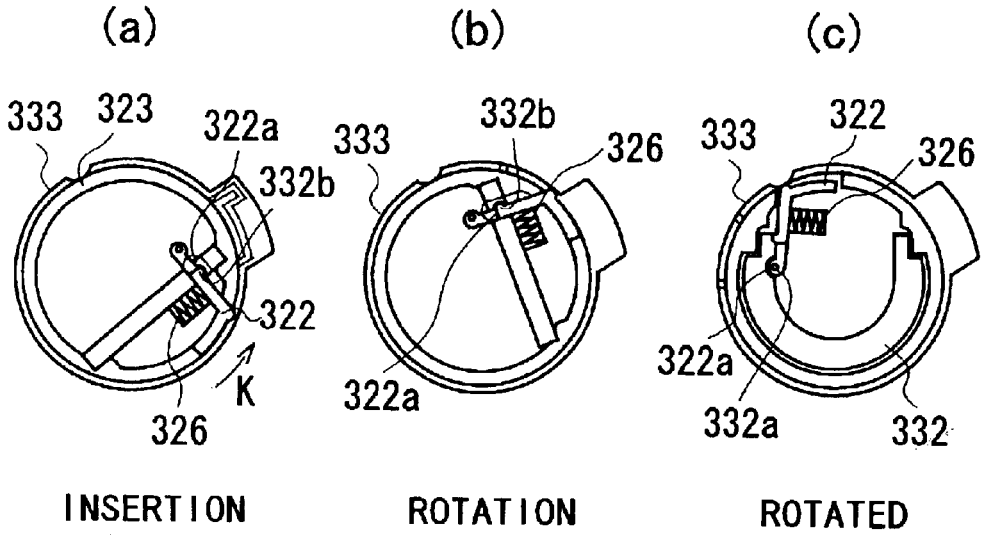
FIGS. 33(*a*), 33(*b*) and 33(*c*) are drawings describing the movement of the toner bottle with a projection for keeping the handle upright, in the fifth embodiment of the present invention.

Next, the toner supply container, process cartridge, and image forming apparatus in the fifth embodiment of the present invention will be described with reference to the appended drawing. FIG. 33 is a drawing describing the movement of the toner bottle in this embodiment, which has a projection for keeping the collapsible handle of the toner container, in the upright or laid down position. The portions of the toner container, process cartridge, and image forming apparatus in this embodiment, which are the same as those in the above described third and fourth embodiments, will be given the same referential symbols as those given in the third embodiment, and will not be described here to avoid the repetition of the same descriptions.

Referring to FIG. 33, the toner supply container, process cartridge, and image forming apparatus in this embodiment are virtually the same as those in the fourth embodiment, except that in this embodiment, the cap 333 of the toner bottle is provided with a lever 322 capable of keeping the handle 332 upright or laid down.

The lever 322 is provided with a square projection 322*a*, which fits into the square hole 332*b* on the inward side of the handle 332, making it possible for the lever 332 to immovably hold the handle 332. The lever 322 is kept under the constant pressure generated in the direction of an arrow mark K by a spring 326, that is, the direction to keep the projection 312*b* in the square hole 332*b* of the handle 332.

Referring to FIGS. 33(*a*)–33(*c*), which show the movement of the lever 322 during the rotation of the toner bottle 331, when the toner bottle 331 is not in the process cartridge 309, the projection 322*a* is in the square hole 332*b* of the handle 332, keeping the handle 332 upright (FIG. 33(*a*)). Therefore, the handle 332 does not jiggle when the toner bottle 331 is handled, even if the toner bottle 331 is full of toner.

When a user is mounting the toner bottle 331 into the process cartridge 309 in the image forming apparatus, first, the user is to open the front door 314*b* of the image forming apparatus, and then, to insert the toner bottle 331 into the process cartridge 309 and rotate the toner bottle 331, by grasping the handle 332 of the toner bottle 331 (FIG. 33(*b*)). During this process of mounting the toner bottle 331, it is assured by the projection 322*a* (lever 332) that the handle 332 remains upright. Therefore, it is possible to apply a greater amount of force when manipulating the toner bottle 331.

Toward the end of the mounting of the toner bottle 331 into the process cartridge 309 (FIG. 33(*c*)), the lever 322 is moved in the direction of an arrow L by the projection 323 of the development unit 310. As a result, the projection 322*a* of the lever 322 is moved out of the square hole 332*b* of the handle 332, freeing thereby the handle 332. Consequently, the handle 332 automatically rotates downward due to its own weight. Therefore, the handle 332 does not interfere with the process of removing the process cartridge 309.

As described above, the toner bottle in this embodiment is provided with a handle usable for inserting the toner bottle into the process cartridge or extracting it therefrom, and this handle is retractable, that is, it is rotatable from the upright position into the laid down position (retracted position) in which the handle does not protrude beyond the external contour of the process cartridge. It is preferable that the handle is retractable from the upright position, that is, the position in which it is kept when the toner bottle is mounted, into the position in which it does not protrude from the external contour of the toner bottle. This structural arrangement eliminates the possibility that the handle will hang up when mounting the process cartridge into the main assembly of the image forming apparatus, or dismounting it therefrom. Further, this structural arrangement makes it possible to reduce the size of the toner bottle, making it therefore possible to reduce the sizes of the process cartridge and image forming apparatus. Moreover, this structural arrangement makes it possible to cause the handle to protrude beyond the external contour of the process cartridge, improving the operational efficiency in the mounting and dismounting of the toner bottle.

Further, the toner bottle in this embodiment is structured so that even if, after the mounting of the toner bottle into the process cartridge, the handle remains in the state in which it was while the toner bottle was inserted into the process cartridge, the handle is rotated downward, that is, it is retracted, by the movement of the process cartridge as the process cartridge is removed from the main assembly of the image forming apparatus. In other words, not only are the toner bottle, process cartridge, and image forming apparatus in this embodiment superior in terms of usability, but also smaller in the space necessary for mounting or dismounting the process cartridge. Further, the toner bottle is superior in operability. In addition, the rotational axis of the handle is disposed away from the center of the end surface of the toner bottle, making it possible to retract the handle into the position in which the handle does not protrude beyond the external contour of the toner bottle as well as the external contour of the process cartridge, while making it easier to grasp the handle.

Further, the direction into which the handle is rotationally laid down is made parallel to the direction in which the process cartridge is removed from the image forming apparatus. Therefore, even if a user does not lay down the handle, the handle is laid down by the edge of the toner bottle insertion-extraction opening, being thereby prevented from being caught by the main assembly of the image forming apparatus, when the process cartridge is removed from the main assembly.

Further, the toner bottle is provided with the lever with the projection, and the handle is provided with the hole, into which the projection of the lever fits to keep the handle in the upright position. The lever is kept under the pressure generated by the spring in the direction to keep the projection in the hole. Toward the end of the mounting of the toner bottle into the process cartridge, the projection, with which the process cartridge is provided, causes the lever to retract, causing thereby the projection to move out of the hole, allowing thereby the handle to automatically rotate downward due to its own weight. With the provision of the above described structural arrangement, it is assured that the handle remains upright while the toner bottle is handled, and that toward the end of the mounting of the toner bottle, the projection is retracted, allowing the handle to automatically rotate downward due to its own weight. In other words, the above described structural arrangement improves the toner bottle in operational.

While the invention has been described with reference to the structures disclosed herein, it is not confined to the details set forth, and this application is intended to cover such modifications or changes as may come within the purposes of the improvements or the scope of the following claims.

What is claimed is:

1. An image forming unit detachably mountable to an image forming apparatus, said image forming unit comprising:

an image forming device configured to form a toner image; and a mounting device, provided inside said image forming unit, configured and positioned to mount a toner supply container configured and positioned to supply toner to said image forming device, wherein said mounting device permits mounting and demounting of the toner supply container relative to said image forming unit when said image forming unit is mounted to the image forming apparatus.

2. An image forming unit according to claim 1, wherein said image forming unit is mountable to and demountable from the image forming apparatus with the toner supply container being mounted to said mounting device.

3. An image forming unit according to claim 2, wherein the mounting and demounting direction in which said image forming unit is mounted to and demounted from the image forming apparatus is different from the mounting and demounting direction of the toner supply container relative to said image forming unit.

4. An image forming unit according to claim 3, wherein the mounting and demounting direction of said image forming unit relative to the image forming apparatus is substantially perpendicular to the mounting and demounting direction of the toner supply container relative to said image forming unit.

5. An image forming unit according to claim 4, wherein said image forming device includes a rotatable image bearing member, and wherein the mounting and demounting direction of said image forming unit relative to the image forming apparatus is substantially perpendicular to a rotational axis of said image bearing member.

6. An image forming unit according to claim 5, wherein said image forming device includes a developing device configured and positioned to develop an electrostatic latent image formed on said image bearing member with the toner supplied from the toner supply container.

7. An image forming unit according to claim 3, wherein the toner supply container comprises a grip provided on the toner supply container and configured and positioned to facilitate an operation of detachably mounting the toner supply container into said image forming unit which is mounted to the image forming apparatus, wherein the grip is retractable from a position in which the grip is used to mount the toner supply container into said image forming unit.

8. An image forming unit according to claim 7, wherein the grip is rotatably mounted on a container body of the toner supply container, and is retracted by rotation thereof.

9. An image forming unit according to claim 8, wherein the grip is retractable to a position where the grip does not project outwardly beyond an outer surface of said image forming unit.

10. An image forming unit according to claim 8, wherein the grip is retractable to a position where the grip does not project outwardly beyond an outer surface of the toner supply container.

11. An image forming unit according to claim 10, wherein the container body is generally cylindrical, and the grip has an outer shape corresponding to the shape of an end of the cylindrical container body, and wherein the outer shape of the grip is opposed to the end of the cylindrical container body over a circumferential length of the end of the cylindrical container body which is larger than one half of the full circumference of the end of the cylindrical container body.

12. An image forming unit according to any one of claims 7–11, wherein the grip is retractable from the position in which the grip is used to mount the toner supply container, with removing of said image forming unit from the image forming apparatus.

13. An image forming unit according to claim 12, wherein the grip is tiltable by abutment to the image forming apparatus, with removing of said image forming unit from the image forming apparatus.

14. An image forming apparatus comprising:

an image forming unit detachably mountable into said image forming apparatus, said image forming unit including an image forming device configured and positioned to form a toner image, and said image forming unit being provided with a toner receiving opening;

a first door member which is openable for mounting and demounting of said image forming unit;

a toner supply container configured and positioned to supply the toner into said image forming device when said toner supply container is mounted in said image forming unit, said toner supply container being provided with a toner discharge opening for fluid communication with said toner receiving opening;

a second door member which is openable for mounting and demounting of said toner supply container; and a limiting device configured and positioned to prevent said second door member from opening when said first door member is open.

15. An apparatus according to claim 14, further comprising a sealing member configured and positioned to provide a seal between said toner receiving opening and said toner discharge opening.

* * * * *

UNITED STATES PATENT AND TRADEMARK OFFICE

CERTIFICATE OF CORRECTION

PATENT NO. : 6,934,492 B2
DATED : August 23, 2005
INVENTOR(S) : Hiura et al.

It is certified that error appears in the above-identified patent and that said Letters Patent is hereby corrected as shown below:

Column 3,
Line 62, “thereof FIGS. 17(a)” should read -- thereof. FIGS. 17(a) --.

Column 8,
Line 6, “p prop 41a” should read -- prop 41a --.

Column 10,
Line 23, “earn 105).” should read -- cam 105). --.

Column 12,
Line 57, “closing” should read -- closing of --.

Column 19,
Line 20, “than the” should read -- than that --.

Column 20,
Line 6, “collapses (rotates” should read -- collapse (rotate --.

Column 22,
Line 8, “operational.” should read -- operation. --.

Signed and Sealed this

Twenty-eighth Day of March, 2006

JON W. DUDAS
*Director of the United States Patent and Trademark Office*